US012606354B2

(12) United States Patent
Stoneberg

(10) Patent No.: US 12,606,354 B2
(45) Date of Patent: Apr. 21, 2026

(54) CHILD-RESISTANT CLOSURE SYSTEM

(71) Applicant: Phoenix Closures, Inc., Aurora, IL (US)

(72) Inventor: Thomas Stoneberg, Buffalo Grove, IL (US)

(73) Assignee: Phoenix Closures, Inc., Aurora, IL (US)

( * ) Notice: Subject to any disclaimer, the term of this patent is extended or adjusted under 35 U.S.C. 154(b) by 0 days.

(21) Appl. No.: 18/891,262

(22) Filed: Sep. 20, 2024

(65) Prior Publication Data

US 2026/0084870 A1 Mar. 26, 2026

(51) Int. Cl.

*B65D 50/04* (2006.01)
*B65D 41/06* (2006.01)
*B65D 51/18* (2006.01)

(52) U.S. Cl.

CPC ..... *B65D 50/043* (2013.01); *B65D 41/06* (2013.01); *B65D 51/18* (2013.01); *B65D 2215/02* (2013.01)

(58) Field of Classification Search

CPC ..... B65D 50/043; B65D 41/06; B65D 51/18; B65D 2215/02
USPC ..... 220/296; 215/208, 222, 223
See application file for complete search history.

(56) References Cited

U.S. PATENT DOCUMENTS 4,049,148 A * 9/1977 Suhr ..... B65D 41/06 215/354
4,627,547 A * 12/1986 Cooke ..... B65D 41/06 215/222
4,753,189 A * 6/1988 Mastman ..... A61J 7/04 215/222
6,450,352 B1 * 9/2002 DeJonge ..... B65D 50/041 215/208
7,451,885 B2 11/2008 Nyman et al.
7,673,763 B1 3/2010 Oh
7,828,166 B1 11/2010 Sprick
7,832,578 B1 * 11/2010 Willis ..... B65D 50/02 215/222
7,861,874 B2 1/2011 Cook et al.
7,922,017 B2 4/2011 Shingle et al.
7,980,427 B2 7/2011 Contiero
8,353,414 B2 1/2013 Luzzato et al.
(Continued)

FOREIGN PATENT DOCUMENTS

WO 2023008996 A1 2/2023
WO 2023192377 A1 10/2023

*Primary Examiner* — Orlando E Aviles
*Assistant Examiner* — Niki M Eloshway
(74) *Attorney, Agent, or Firm* — Husch Blackwell LLP

(57) ABSTRACT

A child-resistant closure system is provided. The child-resistant closure system includes a container including a neck have a mouth defining an opening into a body of the container. The neck includes a first portion of a closure system including a bayonet container component and a retaining container component Further provided is a closure designed to be secured to the container. The closure includes a second portion of the closure system including a plurality of bayonet closure lugs designed to engage with the bayonet container component and the retaining container component. The closure includes a resilient deformable liner that is retained within the closure and designed to be positioned between a finished edge of the container and at least a portion of an interior portion of the closure when the closure is secured to the container.

17 Claims, 17 Drawing Sheets

(56) References Cited

U.S. PATENT DOCUMENTS

| | | | | |
|---|---|---|---|---|
| 8,701,921 | B2 | 4/2014 | Acedo Morono | |
| 9,868,568 | B2 | 1/2018 | Bates et al. | |
| 10,399,728 | B2 | 9/2019 | Brozell et al. | |
| 10,457,453 | B2 | 10/2019 | Stoneberg et al. | |
| D869,279 | S | 12/2019 | Stoneberg | |
| 10,961,031 | B2 | 3/2021 | Riedel et al. | |
| 10,988,289 | B2 | 4/2021 | Yourist et al. | |
| 11,192,700 | B2 | 12/2021 | Sterling et al. | |
| 11,358,764 | B2 | 6/2022 | Sterling et al. | |
| 11,400,025 | B2 | 8/2022 | Roehrig | |
| 11,745,922 | B2 | 9/2023 | French et al. | |
| 11,772,860 | B2 | 10/2023 | Sterling et al. | |
| 2005/0199572 | A1* | 9/2005 | Brozell | B65D 41/0471 215/218 |
| 2007/0039914 | A1* | 2/2007 | Buono | B65D 50/046 215/331 |
| 2007/0062900 | A1* | 3/2007 | Manera | B65D 1/023 215/222 |
| 2012/0325816 | A1* | 12/2012 | Buono | B65D 41/06 220/315 |
| 2014/0263339 | A1* | 9/2014 | Bates | B65D 85/72 220/296 |
| 2019/0144176 | A1* | 5/2019 | Yourist | B65D 50/048 215/217 |
| 2020/0198857 | A1* | 6/2020 | Riedel | B65D 41/0471 |
| 2022/0106088 | A1* | 4/2022 | Ludewig | B65D 53/04 |
| 2023/0211928 | A1 | 7/2023 | Sanchez | |

* cited by examiner

CHILD-RESISTANT CLOSURE SYSTEM

TECHNICAL FIELD

The present disclosure generally relates to a child-resistant closure system for use with a container.

BACKGROUND

Child-resistant containers are designed to prevent children from accessing and accidentally ingesting potentially harmful substances, particularly medications and household chemicals. Thus, child-resistant containers are an important safety measure to reduce the risk of accidental poisoning and ingestion-related injuries in children.

However, child-resistant containers can be expensive to produce because they can require specialized manufacturing processes. Thus, manufacturing child-resistant containers can be more complex and time-consuming compared to standard packaging. Accordingly, some child-resistant containers can have inherent limitations or flaws that can compromise their effectiveness. Thus, it would be beneficial to be able to produce a child-resistant container with a robust closure system using known techniques such as injection blow molding (IBM), extrusion blow molding (EBM), stretch blow molding (SBM), injection stretch blow molding (ISBM), compression molding, and other similar molding techniques known in the art.

Therefore, there is a need for a child-resistant closure system that can prevent young children from inadvertently opening the container to use or ingest the contents of the container while still being readily openable by the efforts of mature adults. Furthermore, there is a need for a child-resistant container that can be produced using known fabrication techniques.

BRIEF SUMMARY

A child-resistant closure system is provided. In an exemplary embodiment, the child-resistant closure system includes a container including a neck including a mouth defining an opening into a body of the container, a finished edge defining the mouth, and a first portion of a closure system including a bayonet container component including a notch designed to engage with a first lug, and a retaining container component designed to engage with a second lug. The system further includes a closure designed to be secured to the container, the closure including a second portion of the closure system including the first lug, the second lug, at least one liner retainer, and at least one stop rib, and a liner held within an interior portion of the closure with the at least one liner retainer. When the closure is secured to the container in a locked configuration the first lug is retained in the notch, the second lug is retained by the retaining container component, and the liner is positioned between the finished edge of the container and at least a portion of the interior portion of the closure when the closure is secured to the container.

In some instances, the neck includes a rim encircling the neck and extending outwardly from the neck at a first distance.

In one aspect, the bayonet container component includes a first segment extending outwardly from the neck and parallel to the rim, the first segment including a stopping portion perpendicular to the rim, a second segment extending outwardly from the neck and connected to a first end of the first segment and extending downwardly at an acute angle from the first segment towards the body of the container, and a third segment extending outwardly from the neck connected to a second end of the first segment opposite the first end, the third segment including a first vertical portion positioned perpendicular to the rim and parallel to the stopping portion.

In another implementation, the third segment includes a first horizontal portion positioned above and parallel to the rim, a second horizontal portion positioned below and parallel to the rim, a third horizontal portion positioned above and parallel to the first horizontal portion, the first vertical portion positioned between and contacting the first horizontal portion and the second horizontal portion, and a second vertical portion positioned between and contacting and the second horizontal portion and the third horizontal portion.

In yet another aspect, the retaining container component includes a fourth segment extending outwardly from the neck and parallel to the rim, and a fifth segment extending outwardly from the neck and having a barbed shape.

In still another instance, the fifth segment includes a fourth horizontal portion parallel to the to the rim, a fifth horizontal portion positioned below and parallel to the rim, and a third vertical portion extending downwardly from the rim at an acute angle and positioned between and contacting the fourth horizontal portion and the fifth horizontal portion.

In some aspects, the container is produced through a molding technique selected from the group consisting of injection blow molding, extrusion blow molding, stretch blow molding, injection stretch blow molding, and compression molding.

In another exemplary embodiment, the child-resistant closure system is provided in the form of a container including a neck including a mouth defining an opening into a body of the container, a first portion of a closure system including a rim encircling the neck and extending outwardly from the neck at a first distance, a plurality of bayonet container components extending outwardly from the neck a second distance greater than the first distance, including a first segment parallel to the rim, the first segment including a stopping portion perpendicular to the rim, a second segment connected to a first end of the first segment and extending downwardly at an acute angle from the first segment towards the body of the container, and a third segment connected to a second end of the first segment opposite the first end, the third segment including a vertical portion positioned perpendicular to the rim and parallel to the stopping portion. Accordingly, a notch is formed between the stopping portion and the vertical portion. Further provided is a closure designed to be secured to the container, the closure including a second portion of the closure system including a plurality of bayonet closure lugs designed to engage with the plurality of bayonet container components, wherein when the closure is secured to the container in a locked configuration the plurality of bayonet closure lugs are each retained in the notch of the plurality of bayonet container components.

In some implementations, the container further includes a plurality of retaining container components designed to engage with one or more of the plurality of bayonet closure lugs.

In another instance, the plurality of bayonet container components and the plurality of retaining container components are positioned in an alternating pattern around the neck.

In still another instance, the second portion of the closure system includes a plurality of liner retainers designed to retain a resilient deformable liner (i.e. deformable liner) with an interior portion of the closure.

In some aspects, the plurality of bayonet closure lugs are axially aligned with the plurality of liner retainers.

In some implementations, the closure includes an interior platform extending downwardly from an interior surface of a top panel of the closure, wherein the interior platform is designed to secure the deformable liner. The interior platform secures the deformable liner such that a central region of the deformable liner is vertically offset from an interior surface of a top panel of the closure.

In some aspects, the second portion of the closure system includes a plurality of stop ribs extending outwardly from an interior portion of a skirt of the neck and arranged in an alternating pattern with the plurality of bayonet closure lugs, wherein the plurality of stop ribs are designed to retard a rotational movement of the plurality of bayonet container components.

In yet another exemplary embodiment, the child-resistant closure system is provided in the form of a container including a hollow body, a neck including a mouth defining an opening into the hollow body, a finished edge defining the mouth, and a first portion of a closure system including a bayonet container component including a notch designed to engage a first lug and a ramp designed to guide a second lug, and a retaining container component designed to engage with the second lug. Further provided is a closure designed to be secured to the container, the closure including a second portion of the closure system including the first lug, the second lug, and at least one liner retainer. A liner is held within an interior portion of the closure with the at least one liner retainer designed to contact the liner. When the closure is secured to the container in a locked configuration the first lug is retained in the notch, the second lug is retained by the retaining container component, and a peripheral portion of the liner is positioned between the finished edge of the container and at least a portion of the interior portion of the closure when the closure is secured to the container. When the closure is transitioned from the locked configuration to an unlocked configuration by a pushing movement applied to the closure so that the liner is deformed by causing the peripheral portion of the liner to move away from the at least one liner retainer, and the pushing movement allows the first lug to disengage from the notch and the second lug to disengage from the retaining container component.

In some instances, in the locked configuration, the at least one liner retainer do not contact the mouth of the container.

In another instance, in the locked configuration, the liner adopts a deformed configuration where an external portion of the liner is positioned above a central portion of the liner.

In some implementations, the notch has a first height, the first lug has a second height approximately equal to the first height, and wherein transitioning the closure from the locked configuration to the unlocked configuration includes pushing the closure down a transitioning distance that is greater than the first height so that the lug disengages from the notch.

In some aspects, in the unlocked configuration, the ramp of the bayonet container component is designed to guide the second lug that disengaged from the retaining container component up and over the bayonet container component as the closure is rotated.

In another aspect, the closure includes a plurality of stop ribs designed to retard the movement of the bayonet container component and the retaining container component when the closure is in the locked configuration.

BRIEF DESCRIPTION OF THE DRAWINGS

In the drawings forming a part of this disclosure.

Figure 1:
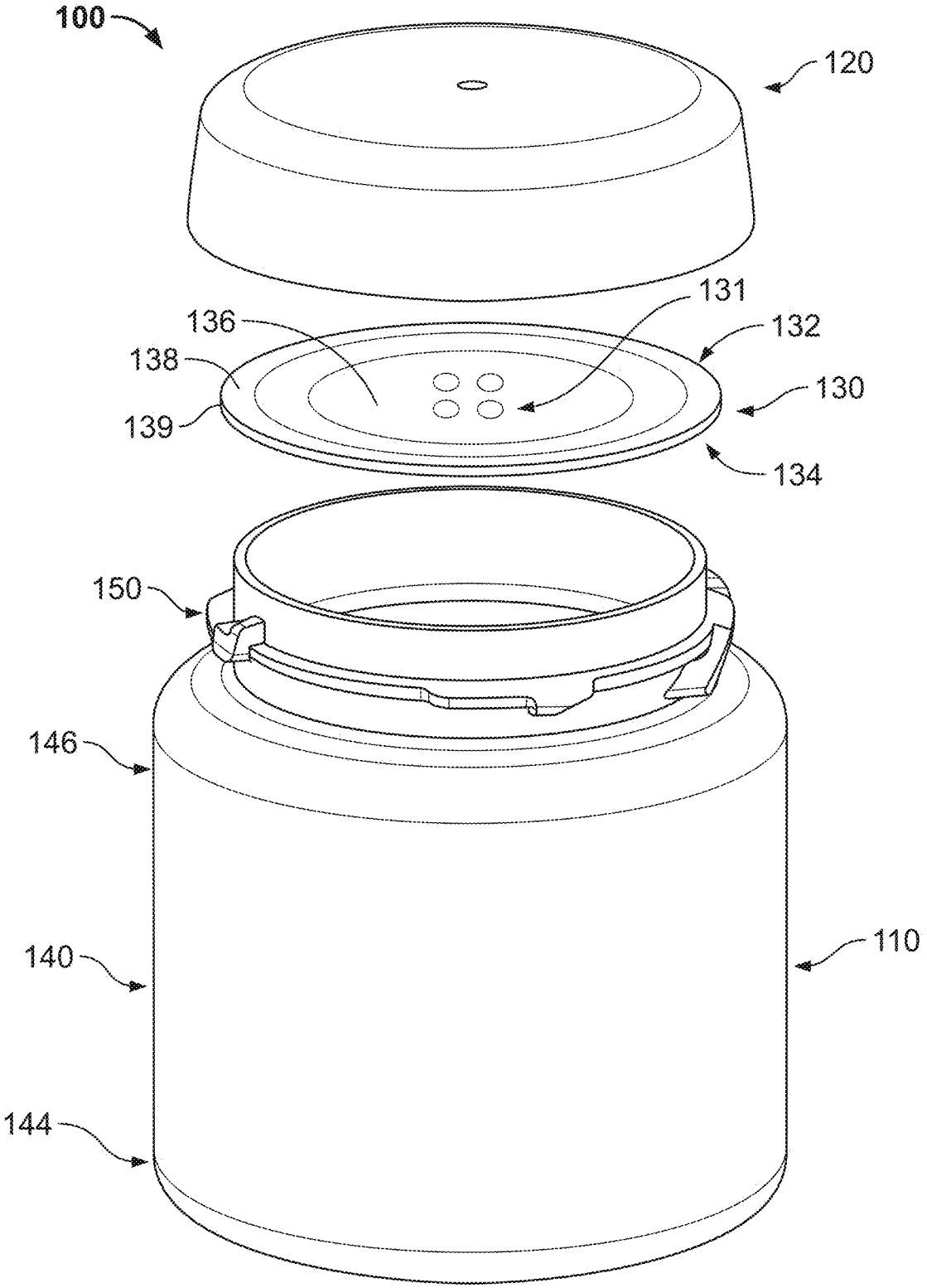
FIG. 1 is an exploded view illustrating several components of a child-resistant closure system, according to an exemplary embodiment of the present disclosure.

Before explaining the disclosed embodiment of the present invention in detail, it is to be understood that the invention is not limited in its application to the details of the particular arrangement shown since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Before any embodiments of the invention are explained in detail, it is to be understood that the invention is not limited in its application to the details of construction and the arrangement of components set forth in the following description or illustrated in the attached drawings. The invention is capable of other embodiments and can be practiced or carried out in various ways. Also, it is to be understood that the phraseology and terminology used herein are for the purpose of description and should not be regarded as limiting. For example, the use of "including," "comprising," or "having" and variations thereof herein is meant to encompass the items listed thereafter and equivalents thereof, as well as additional items.

The present disclosure provides a child-resistant closure system. The closure system includes a container including a finish having a first portion of a closure, a closure having a second portion of a closure, and a resilient deformable liner positioned between the container and the closure. The child-resistant closure system prevents young children from being able to inadvertently open the container to use or ingest the contents of the container while still being readily openable by the efforts of mature adults.

FIG. 1 illustrates an exemplary child-resistant closure system 100 of the present disclosure. The child-resistant closure system 100 includes a container 110, a closure 120, and a resilient deformable liner 130. The closure 120 is designed to be coupled to the container 110. Further, the resilient deformable liner 130 is designed to be secured within the closure 120, such that when the closure 120 is coupled to the container 110, the resilient deformable liner 130 is positioned between at least a portion the container 110 and at least a portion of the closure 120.

The container 110 includes a body 140 and a neck 150. In some instances, the body 140 and the neck 150 are a contiguous body. The body 140 is a hollow structure designed to hold solid and/or fluid contents such as pills and liquid medicine. As shown, the body 140 can have an approximately cylindrical or tubular shape. Accordingly, the body 140 includes a container wall 142, a first end 144 positioned at one end of the container wall 142, and a second end 146 positioned opposite the first end 144. The first end 144 can act as a base (e.g., the container 110 can be placed upright with the first end 144 resting on a surface). In some instances, the first end 144 can have an approximately flat shape. In other instances, the first end 144 can have a molded shape, including one or more depressions designed to stabilize the container 110.

Figure 2:
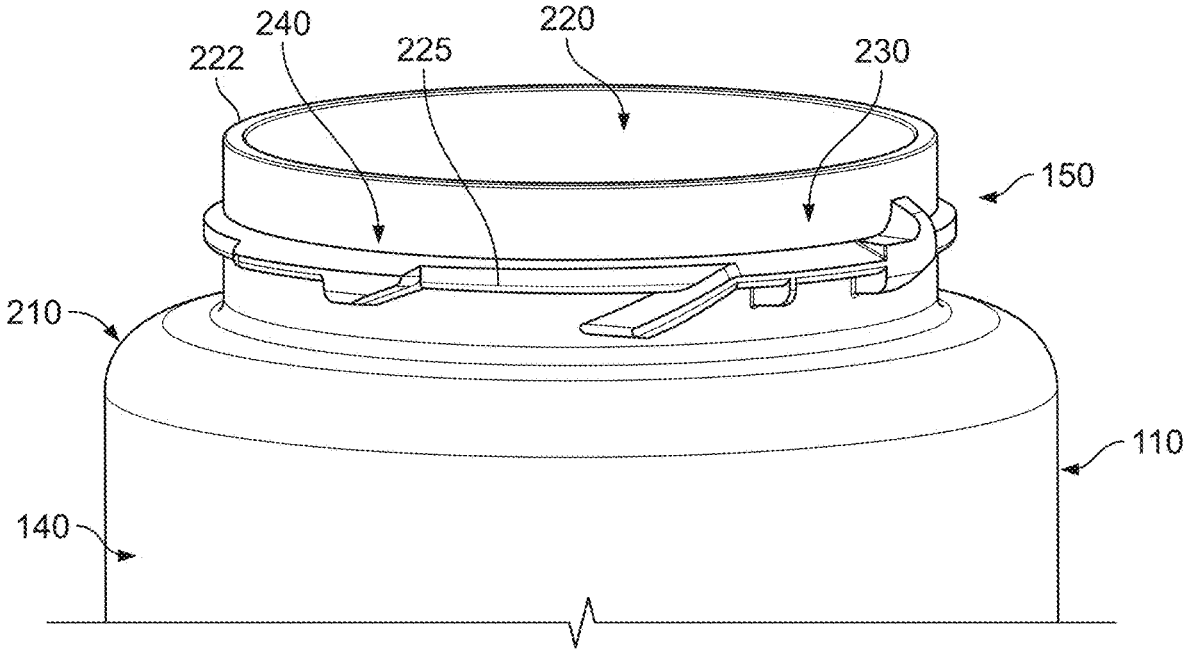
FIG. 2 is a partial side isometric view of a container of the child-resistant closure system of FIG. 1.
Figure 3:
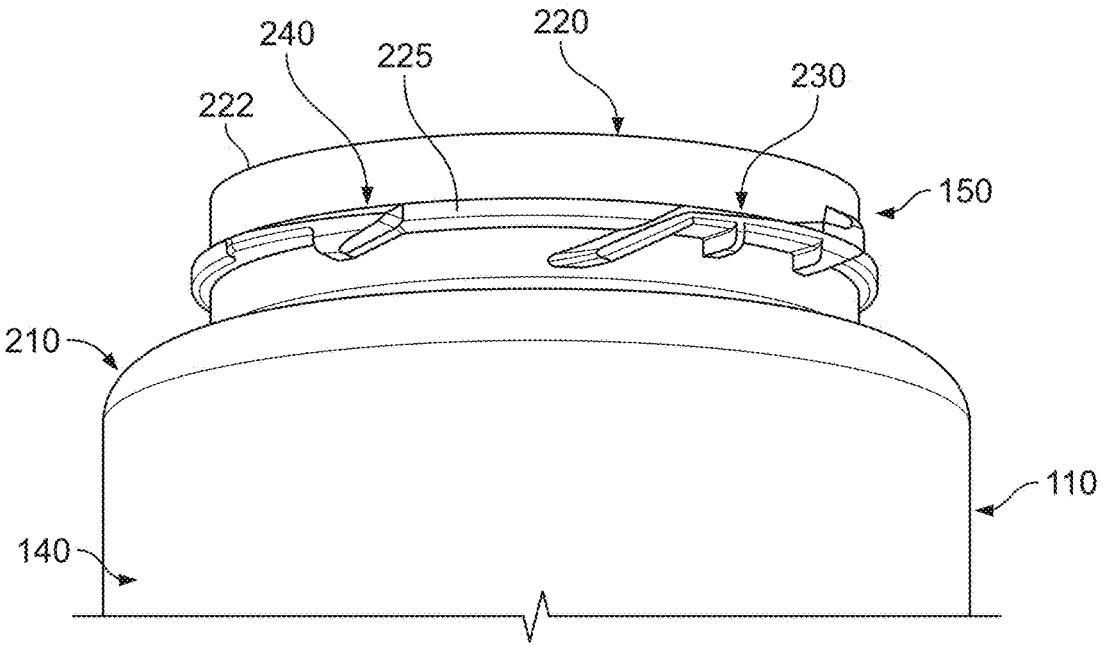
FIG. 3 is a partial bottom isometric view of the container of FIG. 2.

As shown best in FIGS. 2 and 3, the second end 146 can include a shoulder 210. The body 140 can have a larger size or circumference than the neck 150. Therefore, the shoulder 210 connects the body 140 to the neck 150 and is designed to provide structural support and transition the container's 110 shape from the larger body 140 to the smaller neck 150. Thus, the shoulder 210 can have a sloped or curved shape.

The neck 150 can have a similar shape to the body 140. Therefore, in the present example, the neck 150 has an annular and/or cylindrical shape similar to that of the body 140. As mentioned above, the neck 150 can have a smaller circumference than the body 140, which can improve aesthetics when the closure 120 is attached, reduce material costs, and enhance the pouring and dispensing of the contents of the container 110.

The neck 150 includes a mouth 220 designed to form an access to the internal contents within the container 110. The mouth 220 can include a finished edge 222 outlining or defining the mouth 220. In some instances, the finished edge 222 can have a rounded or smooth shape designed to provide an even surface that can form a tight and secure fit when the closure 120 is coupled to the container 110. In other instances, the finished edge can have a relatively flat or planar design.

As discussed in more detail with reference to FIGS. 1-8, the resilient deformable liner 130 can contact the finished edge 222 when the closure 120 is coupled to the container 110. Accordingly, the container 110 includes a first portion of a closure system, and the closure 120 includes a second portion of the closure system, wherein the first portion and the second portion of the closure system are designed to interact with each other.

The first portion of the closure system is connected to or formed as part of the neck 150. The first portion of the closure system can include one or more structures for engaging one or more structures of the second portion of the closure system included in the closure 120. In the exemplary embodiment shown in FIGS. 1-8, the first portion of the closure system includes a rim 225, at least one bayonet container component 230, and at least one retaining container component 240.

The at least one bayonet container component 230 and the at least one retaining container component 240 can be connected to, or part of, the rim 225. The rim 225 encircles the neck 150 and extends outwardly from the neck 150 at a first distance. The at least one bayonet container component 230 and the at least one retaining container component 240 extend from the neck 150 at a second distance greater than the first distance. In other words, the at least one bayonet container component 230 and the at least one retaining container component 240 extend past the rim 225.

Figure 4:
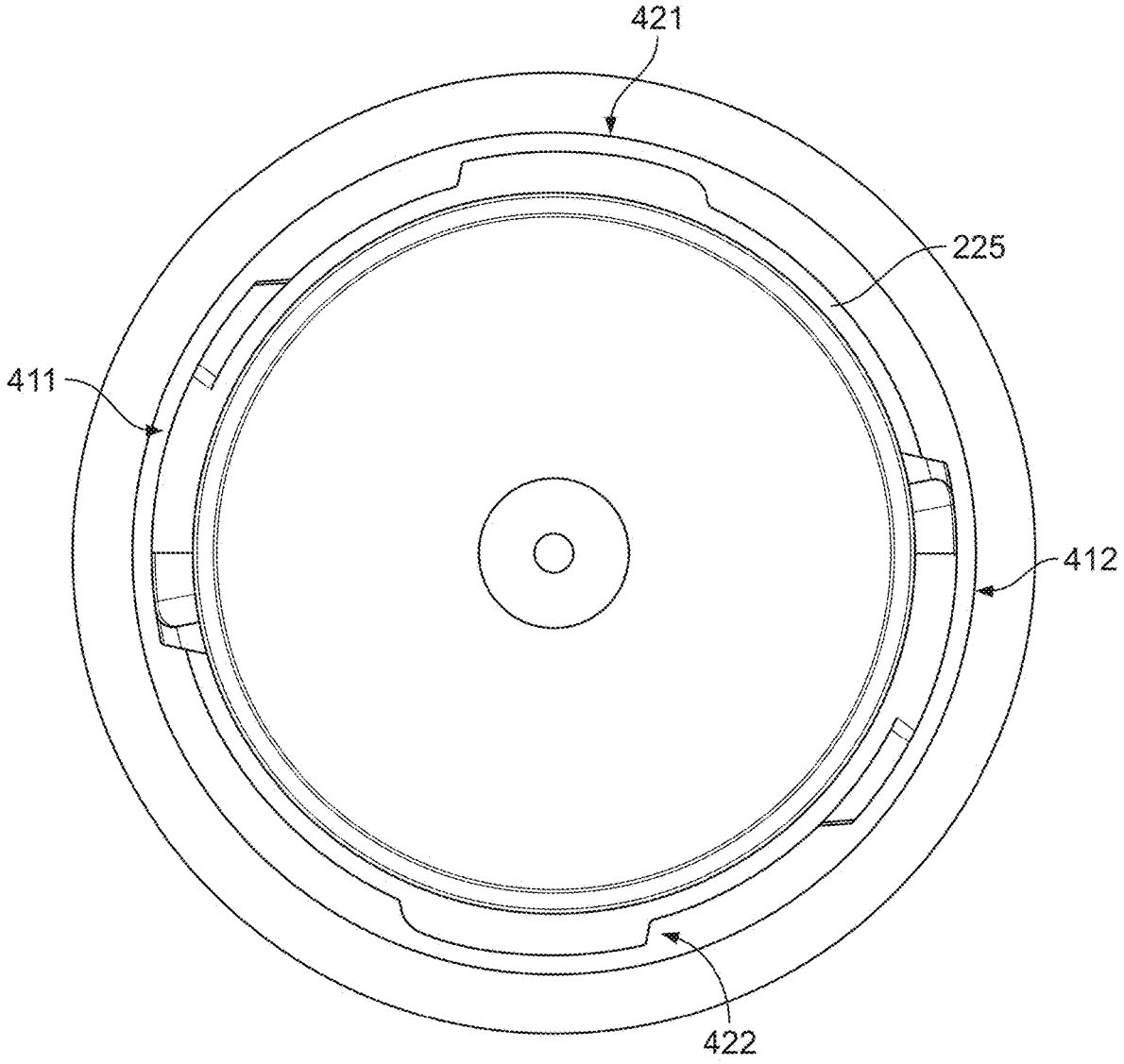
FIG. 4 is a top elevational view of the container of FIG. 2.

In some instances, the first portion of the closure system includes multiple bayonet container components 230 and retaining container components 240 arranged around a circumference of the neck 150. As shown in FIG. 4, the first portion of the closure system of the container 110 can include a first bayonet container component 411 and a second bayonet container component 412 positioned approximately opposite the first bayonet container component 411.

The first portion of the closure system of the container 110 can further include a first retaining container component 421 and a second retaining container component 422 positioned approximately opposite the first retaining container component 421. The first retaining container component 421 can be positioned between the first bayonet container component 411 and the second bayonet container component 412. Accordingly, the second retaining container component 422 can be positioned between the first bayonet container component 411 and the second bayonet container component 412, on an opposite side of the neck 150.

In some aspects, the first retaining container component 421 and the second retaining container component 422 are positioned at approximately equal distances from the first bayonet container component 411 and the second bayonet container component 412. In other aspects, the first retaining container component 421 and the second retaining container component 422 can be positioned closer to the first bayonet container component 411 or the second bayonet container component 412.

Figure 5:
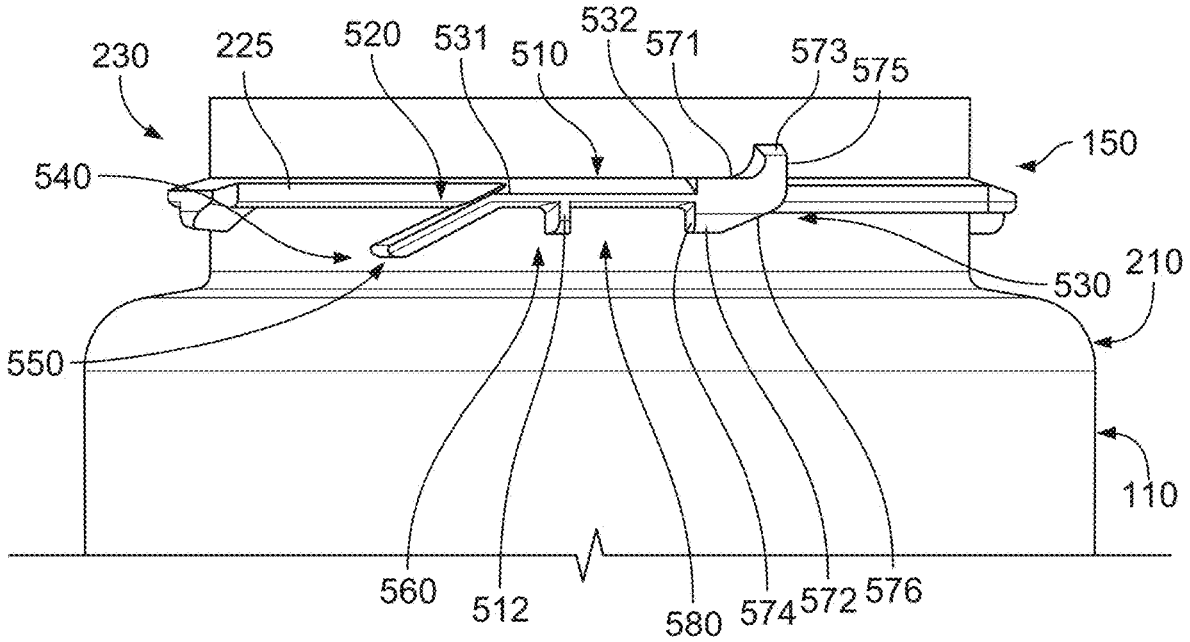
FIG. 5 is a partial side elevational view of the container of the child-resistant closure system of FIG. 1, illustrating a first closure component of the container.
Figure 6:
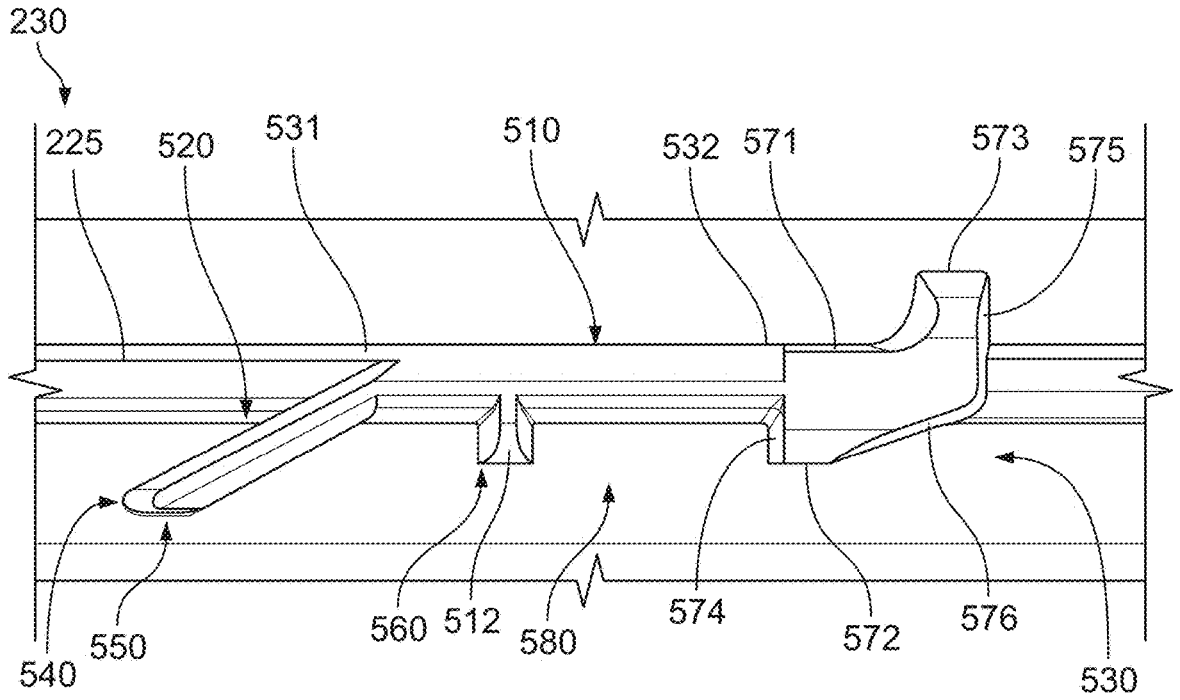
FIG. 6 is a partial zoomed in view of the first closure retaining component.

FIGS. 5 and 6 illustrate the at least one bayonet container component 230 in more detail. The at least one bayonet container component 230 includes a first segment 510, a second segment 520, and a third segment 530. In some instances, the first segment 510, the second segment 520, and the third segment 530 form a single contiguous body.

The first segment 510 is a generally straight component that extends along a length of the rim 225. The first segment 510 includes a stopping portion 512, that extends downwardly from the first segment 510, at an approximately 90° angle. In some instances, the stopping portion 512 is positioned in approximately the center of the first segment 510. In other instances, the stopping portion 512 is positioned closer to the second segment 520 or the third segment 530. Further, the stopping portion 512 does not extend to a bottom of the neck 150. In other words, the stopping portion 512 does not touch the bottom of the neck 150 or the shoulder 210 of the container 110.

The second segment 520 is connected to, or extends from, a first end 531 of the first segment 510. The second segment 520 extends downwardly at a first acute angle relative to the first segment 510, and the rim 225. The second segment 520 does not extend to a bottom of the neck 150. In other words, the second segment 520 does not touch the bottom of the neck 150 or the shoulder 210 of the container 110. Accordingly, there is a gap 540 between a bottom point 550 of the second segment 520 and the shoulder 210. However, the second segment 520 can extend past a bottom point 560 of the stopping portion 512. As discussed herein, the second segment 520 can act as a guide for components of the closure 120. In some instances, the second segment 520 is approximately the same length as the first segment 510. In other instances, the second segment 520 is a different length than the first segment 510.

The third segment 530 is connected to, or extends from, a second end 532, opposite the first end 531, of the first segment 510. The third segment 530 includes a first horizontal portion 571, parallel to the rim 225. In some instances, the first horizontal portion 571 is positioned above the rim 225. In other instances, the first horizontal portion 571 is positioned at the same height as the rim 225. The third segment 530 further includes a second horizontal portion 572, parallel to the first horizontal portion 571, and positioned below the rim 225. The second horizontal portion 572 can have a shorter length than the first horizontal portion 571. The third segment 430 also includes a third horizontal portion 573 positioned above the first horizontal portion 571.

The third segment 530 includes a first vertical portion 574 positioned between and contacting the first horizontal portion 571, and the second horizontal portion 572. The first vertical portion 574 is positioned at an approximately 90° angle as compared to the first horizontal portion 571, and the second horizontal portion 572. Thus, the first vertical portion 574 is approximately parallel to the stopping portion 512. Further, similarly to the stopping portion 512, the first vertical portion 574 extends downwardly from the rim 225. However, the first vertical portion 574 does not extend to a bottom of the neck 150. In other words, the second segment 520 does not touch the shoulder 210 of the container 110. Thus, a notch 580 is formed between the stopping portion 512 and the first vertical portion 574.

The third segment 530 further includes a second vertical portion 575, parallel to the first vertical portion 574. The second vertical portion 575 is positioned between and contacting the third horizontal portion 573 and an angled portion 576. The angled portion 576 is positioned between and contacting the second vertical portion 575 and the second horizontal portion 572. The angled portion 576 can be angled at an acute angle relative to the rim 225. As discussed herein with reference to FIGS. 13-15, the angled portion 576 can act as a guide for components of the closure 120.

Figure 7:
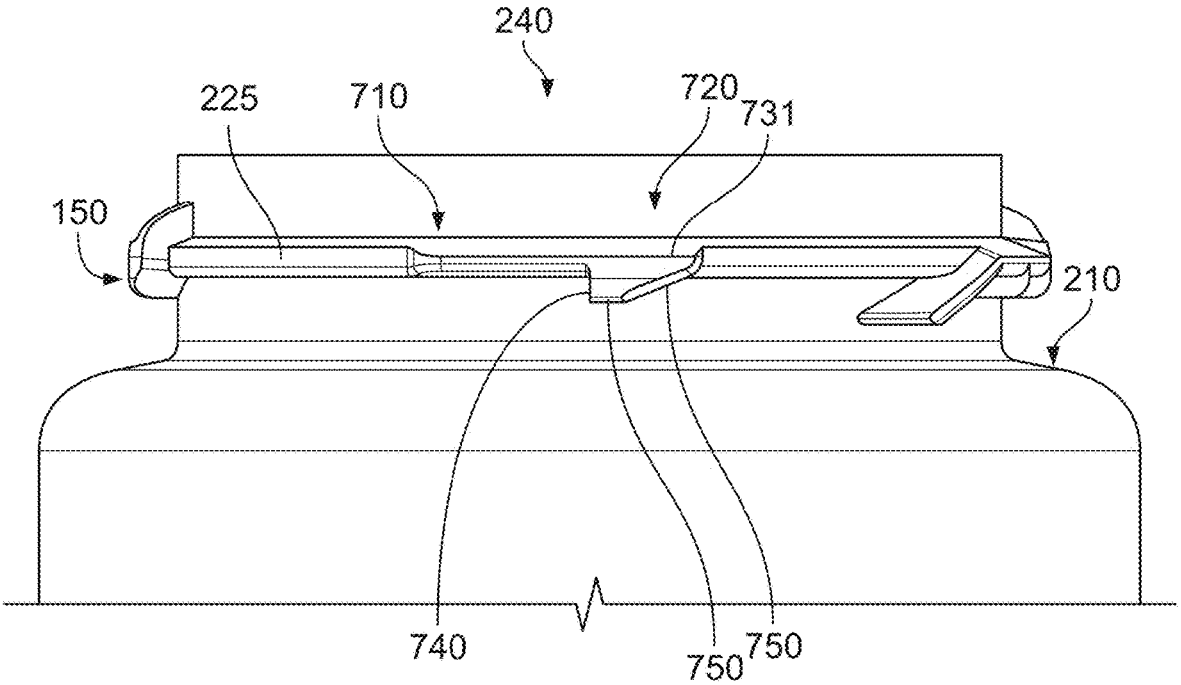
FIG. 7 is a partial side elevational view of the container the child-resistant closure system of FIG. 1, illustrating a second closure retaining component.
Figure 8:
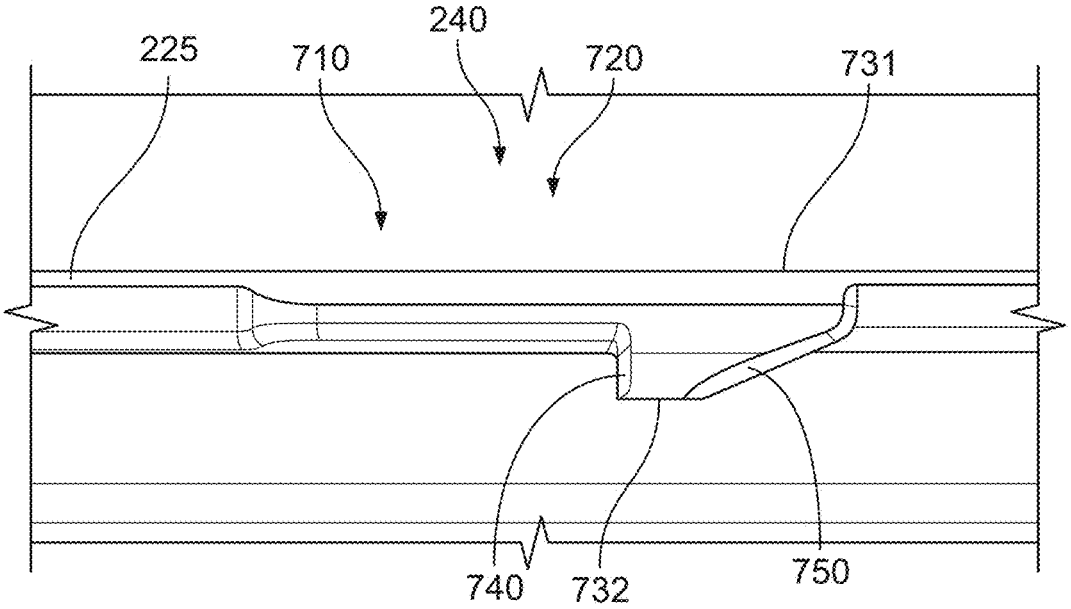
FIG. 8 a partial zoomed in view of the second closure retaining component.

FIGS. 7 and 8 illustrate the at least one retaining container component 240 in more detail. The at least one retaining container component 240 includes a fourth segment 710, and a fifth segment 720. In some instances, the fourth segment 710, and the fifth segment 720, form a single contiguous body.

The fourth segment 710 is a generally horizontal segment parallel to the rim 225. In some instances, the fourth segment 710 is on the same plane as the rim 225. The fifth segment 720 has a general harpoon or barbed shape. Specifically, the fifth segment 720 includes a fourth horizontal portion 731. The fourth horizontal portion 731 can be on the same plane as the fourth segment 710. In other words, there may be no separation or elevation change between the fourth segment 710 and the fourth horizontal portion 731. The fifth segment 720 can further include a fifth horizontal portion 732, parallel to the fourth horizontal portion 731. The fifth horizontal portion 732 can be shorter than the fourth horizontal portion 731. The fifth horizontal portion 732 can be positioned below the rim 225.

The fifth segment 720 also includes a third vertical portion 740 (also referred to as a retaining barb surface), extending downwardly from the rim 225 and/or the fourth segment 710. However, the third vertical portion 740 does not extend down to the bottom of the neck 150 (e.g., the third vertical portion 740 does not contact the shoulder 210). The third vertical portion 740 is positioned between and in contact with the fourth segment 710, and the fifth horizontal portion 732. The fifth segment 720 still further includes a second angled portion 750 (also referred to as a retaining lead-in) positioned between and contacting the fourth horizontal portion 731 and the fifth horizontal portion 732. The second angled portion 750 can be angled at an acute angle relative to the rim 225. As discussed herein with reference to FIGS. 13-15, the second angled portion 750 can act as a guide for components of the closure 120.

Figure 9:
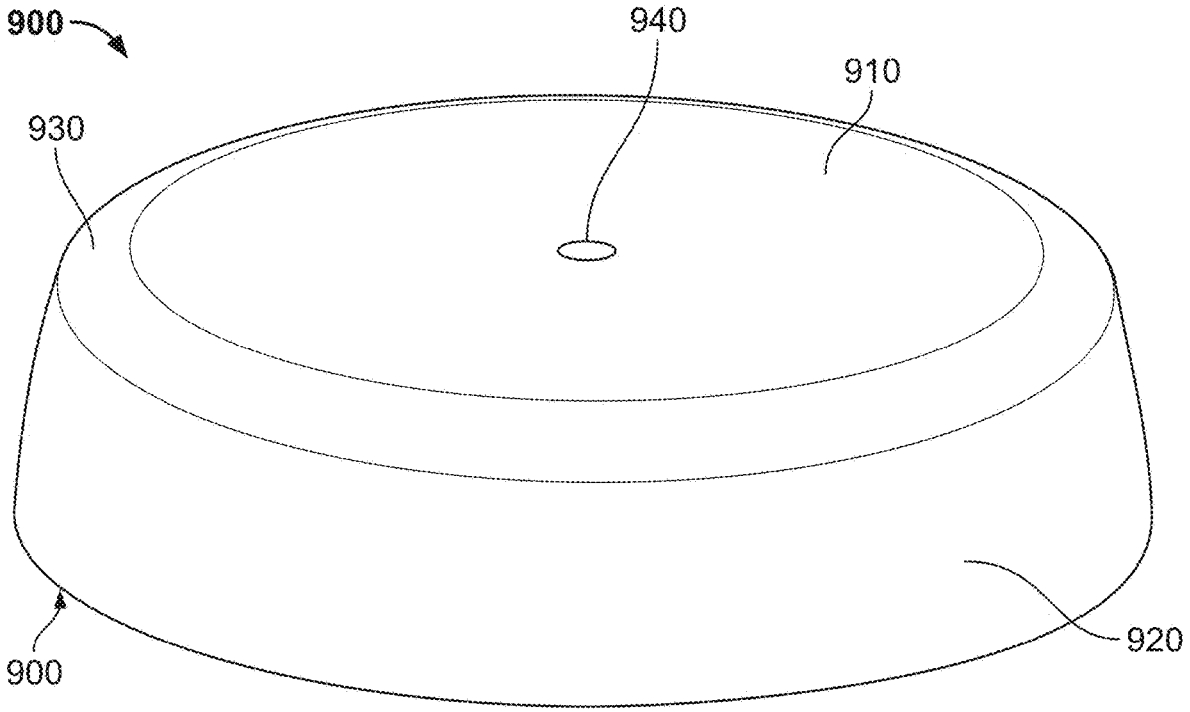
FIG. 9 is a top isometric view of an exemplary closure according to an embodiment of the disclosure.

FIG. 9 illustrates an exemplary closure 900. The closure 900 can be the closure 120 of FIG. 1. The closure 900 can have a generally round or circular shape. The closure 900 includes a top panel 910 and a skirt 920, depending from a peripheral edge 930 of the top panel 910. A center of the top panel 910 can be located in a central portion 940 of the top panel 910. As shown, in some instances, the top panel 910 can define a generally flat surface. In other instances, the top panel 910 can be concave, convex, angled, contoured, or textured. The top panel 910 can be positioned substantially perpendicular to the skirt 920. Accordingly, the skirt 920 extends downwardly from the peripheral edge 930 away from the top panel 910. In some instances, the peripheral edge 930 has a generally rounded, convex, or curved shape.

Figure 10:
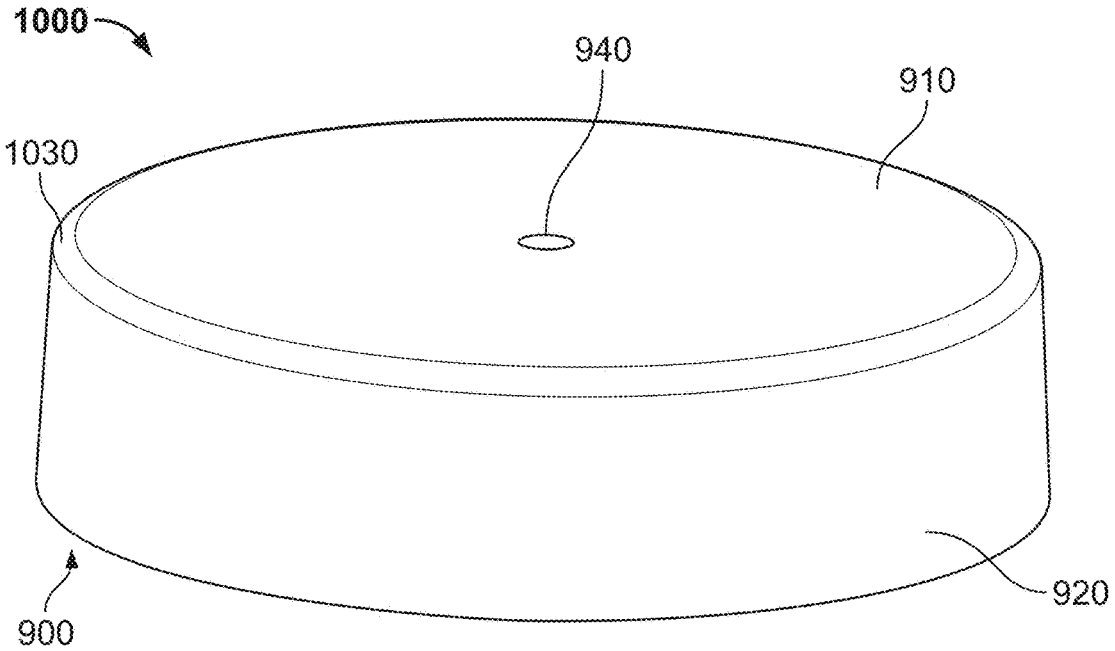
FIG. 10 is a top isometric view of another exemplary closure according to an embodiment of the disclosure.

FIG. 10 illustrates another exemplary closure 1000. The closure 1000 can be the closure 120 of FIG. 1. The closure 1000 is similar to the closure 900 of FIG. 9. However, a peripheral edge 1030 can have a substantially right angle. In other words, the closure 1000 can have a disk-like structure.

Figure 11:
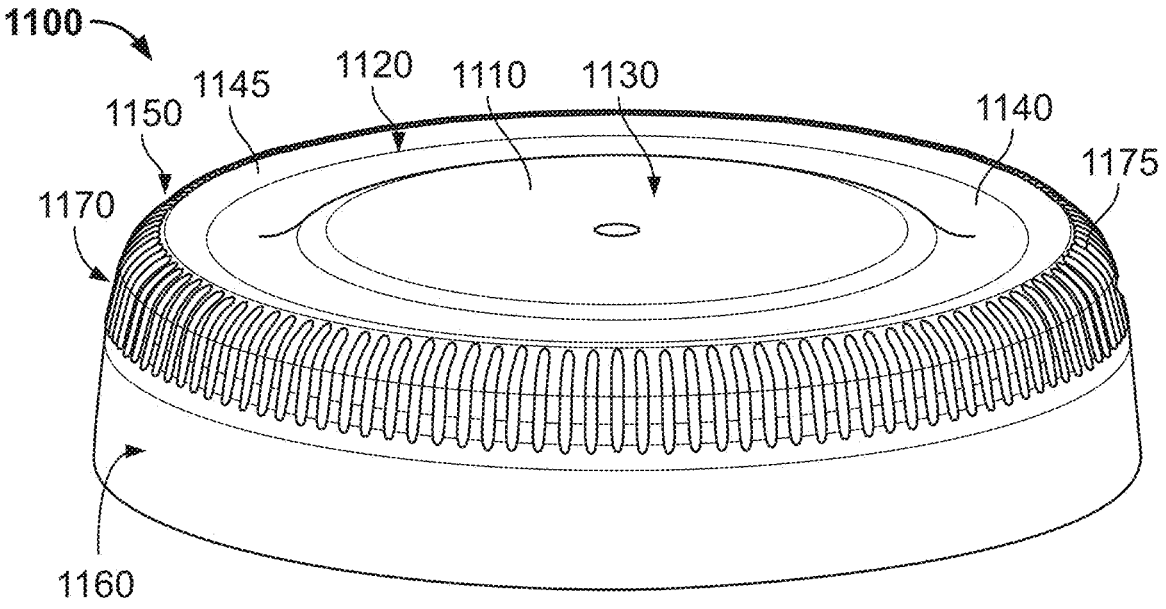
FIG. 11 is a top isometric view of yet another exemplary closure according to an embodiment of the disclosure.

FIG. 11 illustrates yet another exemplary closure 1100. The closure 1100 can be the closure 120 of FIG. 1. The closure 1100 is similar to the closure 900 of FIG. 9. However, a top panel 1110 can include a depressed portion 1120. A central portion 1130 of the top panel 1110 can be surrounded by portions having different elevations than the central portion 1130. The central portion 1130 can be surrounded or bounded by a portion 1140 that is depressed in elevation (e.g., the depressed portion 1120). The depressed portion 1120 can be surrounded or bounded by a portion 1145, which has a higher or heightened elevation than the depressed portion 1120. The portion 1145 can have an elevation higher than, lower than, or equal to the central portion 1130. The portion 1145 can be surrounded or bounded by the periphery 1150 of the top panel 1110. The central portion 1130, the depressed portion 1120, and the portion 1145 can directly contact each other, respectively, or be separated by additional portions in the top panel 1110.

In some instances, the central portion 1130 can include a circular or round central region of the top panel 1110. As shown, each of the depressed portion 1120, the portion 1145, and the periphery 1150, respectively, can define rings or annular structures disposed concentrically around the central portion 1130.

The closure 1100 can include a skirt 1160 depending from a peripheral edge 1170 of the top panel 1110. In some instances, the peripheral edge 1170 has a rounded, curved, or convex shape. In some instances, the peripheral edge 1170 includes a plurality of grooves and/or lateral projections 1175 designed to provide a textured surface that can make it easier for a user to grip the closure 1100.

Figure 12A:
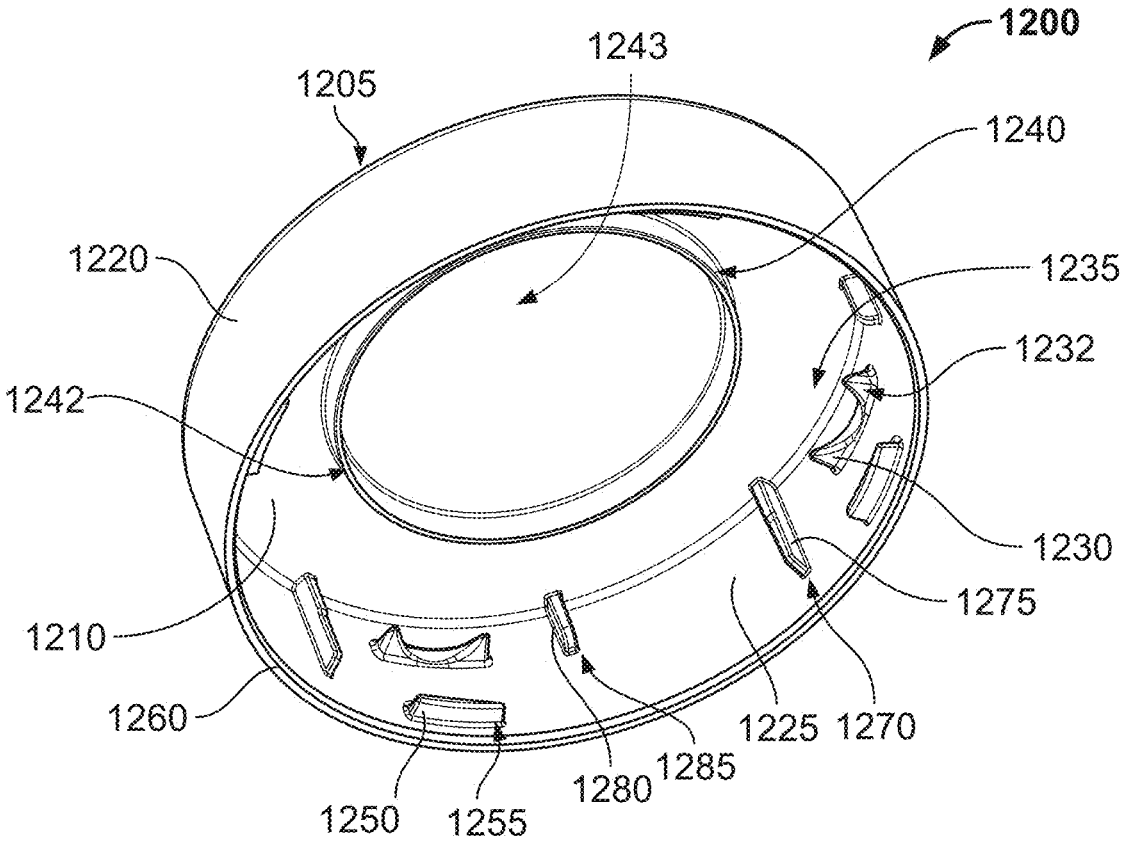
FIG. 12A is a bottom isometric view of a closure of the child-resistant closure system of FIG. 10.

FIG. 12A illustrates a bottom or internal view of the components of a closure 1200 of the child-resistant closure system disclosed herein. More specifically, FIG. 12A shows components of the second portion of the closure system designed to work in conjunction with the components of the first portion of the closure system disclosed herein. The closure 1200 can be the closure 900 of FIG. 9, the closure 1000 of FIG. 10, or the closure 1100 of FIG. 11. In other words, each of the closures 900, 1000, and 1110 can include the same components of the second portion of the closure system.

The closure 1200 includes an interior surface 1210 of a top panel of the closure 1200, such as the top panel 910 of FIGS. 9 and 10 and/or the top panel 1110 of FIG. 11. The bounds and shape of the interior surface 1210 can be defined by a skirt 1220. The skirt 1220 can be the skirt 920 of FIGS. 9 and 10 and/or the skirt 1160 of FIG. 11. An interior surface 1225 of the skirt 1220 includes various components of the second portion of the closure system.

In particular, the interior surface 1225 of the skirt 1220 includes one or more liner retainers 1230 designed to secure, support, buttress, or retain the resilient deformable liner 130 within the interior of the closure 1200. The one or more liner retainers 1230 can include one or more projections or spikes 1232 that extend outwardly from the interior surface 1225 of the skirt 1220 at an approximately 90° angle. The one or more liner retainers 1230 are positioned around the circumference of the interior surface 1225 of the skirt 1220. The one or more liner retainers 1230 can be spaced a first distance 1235 from the interior surface 1210 of the top panel 1205. The first distance 1235 provides room for the resilient deformable liner 130 to be inserted between the one or more liner retainers 1230 and the interior surface 1210 of the top panel 1205.

An interior platform 1240 can be designed to further secure the resilient deformable liner 130. The interior platform 1240 can extend downwardly from the interior surface 1210 of the top panel 1205. In some instances, a bottom planar surface 1242 of the interior platform 1240 is on a plane above an upper most point or surface of the one or more liner retainers 1230. In other words, there can be a space or gap between a bottom planar surface of the interior platform 1240 and a top planar surface of the one or more liner retainers 1230. Accordingly, that space can accommodate the thickness of the resilient deformable liner 130. Further, the space can provide room for the resilient deformable liner 130 to move or deform within the interior of the closure 120.

As shown in FIG. 12A, the interior platform 1240 can be provided in the form of a concentric structure that mimics the shape of the interior surface 1210. However, the interior platform 1240 can be provided in various shapes and forms. In some examples, the shape of the interior platform 1240 can provided in the form of a polygon such as a rectangle-like, a pentagon-like, a hexagon-like, an octagon-like structure, or similar shapes.

As discussed in more detail with reference to FIGS. 15 and 16, the bottom planar surface 1242 can contact the resilient deformable liner 130. Thus, the bottom planar surface 1242 can also be referred to as a contact surface. In some examples, the interior platform 1240 is a wall-like structure that extends downwardly from the interior surface 1210 of the top panel 1205. For example, as shown in FIG. 12A, the interior platform 1240 is a ring-like structure. Thus, at least some of the interior surface 1210 of the top panel 1205 is within the "walls" of the interior platform 1240. This area can be referred to as a central area 1243. In the exemplary embodiment shown in FIG. 12A, the bottom planar surface 1242 does not cover the central area 1243. Accordingly, when the resilient deformable liner 130 is installed in the closure 1200, the central area 1243 can form a hollow interior section.

Figure 12B:
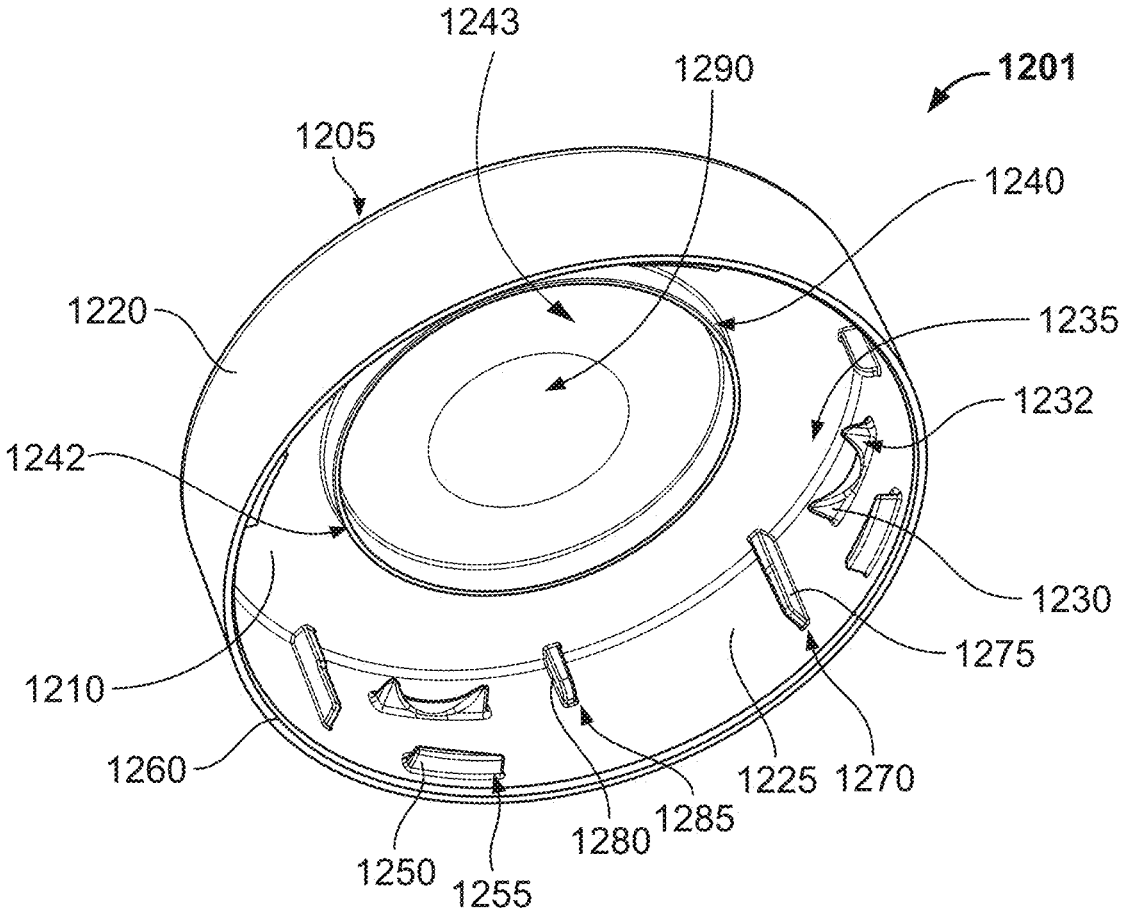
FIG. 12B is a bottom isometric view of a closure of the child-resistant closure including a moisture control device.

As shown in FIG. 12B, in an exemplary embodiment, a closure 1201 can include a humidity control device 1290 placed within the hollow interior of the interior platform 1240 (e.g., the hollow area formed within the central area 1243 when the resilient deformable liner 130 is installed in the closure 1201). The humidity control device 1290 can be provided in the form of a desiccant or humectant packet or device. Referring back to FIG. 1, in some instances the resilient deformable liner 130 can include a plurality of perforations 131. The plurality of perforations 131 can permit air to flow in/out of the hollow interior. Thus, when the closure 1201 is installed on a container (e.g., the container 110 of FIG. 1. Thus, when the closure 1201 is installed on a container (e.g., the container 110 of FIG. 1), the desiccant or humectant packet or device 1290 can help control a humidity level within the container.

The closures 1200 and 1201 further include one or more bayonet closure lugs 1250 positioned around the circumference of the interior surface 1225 of the skirt 1220. The one or more bayonet closure lugs 1250 are positioned a second distance 1255 from a bottom rim 1260 of the skirt 1220. In some instances, the one or more bayonet closure lugs 1250 are positioned approximately underneath the one or more liner retainers 1230. In some instances, where the one or more bayonet closure lugs 1250 are axially aligned with the one or more liner retainers 1230, it can be preferable that a distance between the one or more bayonet closure lugs 1250 and the one or more liner retainers 1230 is approximately equal to or greater than the size or height of the third segment 530 of the at least one bayonet container component 230 as shown in FIG. 5.

However, the one or more bayonet closure lugs 1250 can be offset from the one or more liner retainers 1230. As discussed in more detail in FIGS. 15-17, the one or more bayonet closure lugs 1250 are designed to interact with the at least one bayonet container component 230 of FIG. 2. In particular, the one or more bayonet closure lugs 1250 can be sized to fit within the notch 580 of the at least one bayonet container component 230 and/or sized to interact with the at least one retaining container component 240 as shown in FIG. 5.

The closures 1200 and 1201 also include a plurality of stop ribs 1270 designed to interact with the at least one bayonet container component 230 and/or the at least one retaining container component 240 of FIG. 2. Further, the plurality of stop ribs 1270 can be designed to limit the distance that the closures 1200 and 1201 can rotate around the container, such as the container 110 of FIG. 1, when the closures 1200 and/or 1201 and the container are engaged.

The plurality of stop ribs 1270 can define a structure resembling a ridge, with the ridge oriented to be substantially perpendicular to the interior surface 1210 of the top panel 1205 and/or the interior surface 1225 of the skirt 1220. The plurality of stop ribs 1270 can include flat or substantially flat surfaces. The stop ribs can include surfaces that are curved or angled or have a profile with a triangular shape when viewed in cross-section.

The plurality of stop ribs 1270 extend laterally across the interior surface 1225 of the skirt 1220 and are positioned approximately perpendicular to the top panel 1205 of the closure 1200. The plurality of stop ribs 1270 also extend outwardly from the interior surface 1225 of the skirt 1220. The plurality of stop ribs 1270 can be positioned around the circumference of the interior surface 1225. A bottom end of the plurality of stop ribs 1270 can be a third distance 1275 from the bottom rim 1260 of the skirt 1220. In some instances, the plurality of stop ribs 1270 are positioned at approximately equal intervals around the circumference of the interior surface 1225 between two liner retainers 1230. However, the plurality of stop ribs 1270 may not be equally spaced between the two liner retainers 1230. Rather, one stop rib of the plurality of stop ribs 1270 can be placed closer to one liner retainer 1230 as compared to another liner retainer 1230. As discussed in more detail in FIGS. 15-17, the plurality of stop ribs 1270 can be designed to interact with the third segment 530 of the at least one bayonet container component 230 and/or the at least one retaining container component 240.

The closures 1200 and 1201 can include a plurality of liner ribs 1280 designed to center the resilient deformable liner 130 within the underside of the closures 1200 and 1201 when the resilient deformable liner 130 is installed in the closures 1200 and/or 1201. In other words, the plurality of liner ribs 1280 help maintain the resilient deformable liner 130 at an approximately equal distance from the interior surface 1225 of the skirt 1220 around the circumference of the closure 1200.

The plurality of liner ribs 1280 extend laterally across the interior surface 1225 of the skirt 1220 and are positioned approximately perpendicular to the top panel 1205 of the closures 1200 and 1201. The plurality of liner ribs 1280 also extend outwardly from the interior surface 1225 of the skirt 1220. A bottom end of the plurality of stop ribs 1270 can be a fourth distance 1285 from the bottom rim 1260 of the skirt 1220. The plurality of liner ribs 1280 can be positioned around the circumference of the interior surface 1225. In some instances, the plurality of liner ribs 1280 are positioned at approximately equal intervals around the circumference of the interior surface 1225 between two liner retainers 1230.

However, the plurality of liner ribs 1280 may not be equally spaced between the two liner retainers 1230. Rather, one liner rib of the plurality of liner ribs 1280 can be placed closer to one liner retainer 1230 as compared to another liner retainer 1230. In particular, the plurality of liner ribs 1280 can be placed on an opposite side of one of the liner retainers 1230. In other words, a stop rib of the plurality of stop ribs 1270 and a liner rib of the plurality of liner ribs 1280 can be positioned between two liner retainers 1230. However, each of the plurality of stop ribs 1270 and the plurality of liner ribs 1280 can be relatively closer to one of the two liner retainers 1230. As discussed in more detail in FIGS. 15-17, the plurality of stop ribs 1270 can be designed to interact with the third segment 530 of the at least one bayonet container component 230.

In some instances, the plurality of liner ribs 1280 are shorter than the plurality of stop ribs 1270 (e.g., the third distance 1275 is less than the fourth distance 1285). In other instances, the plurality of liner ribs 1280 are the same length as the plurality of stop ribs 1270 (e.g., the third distance 1275 and the fourth distance 1285 are approximately equal). In still other instances, the plurality of liner ribs 1280 are longer than the plurality of stop ribs 1270 (e.g., the third distance 1275 is greater than the fourth distance 1285).

It is to be understood that although FIGS. 9-12B show the closures 900, 1000, 1100, 1200, and 1201, as having a generally circular shape. The closures discussed herein can be provided in other shapes. For instance, as discussed in more detail in FIGS. 22 and 23, a closure can be provided in a generally square or rectangular shape.

Figure 13:
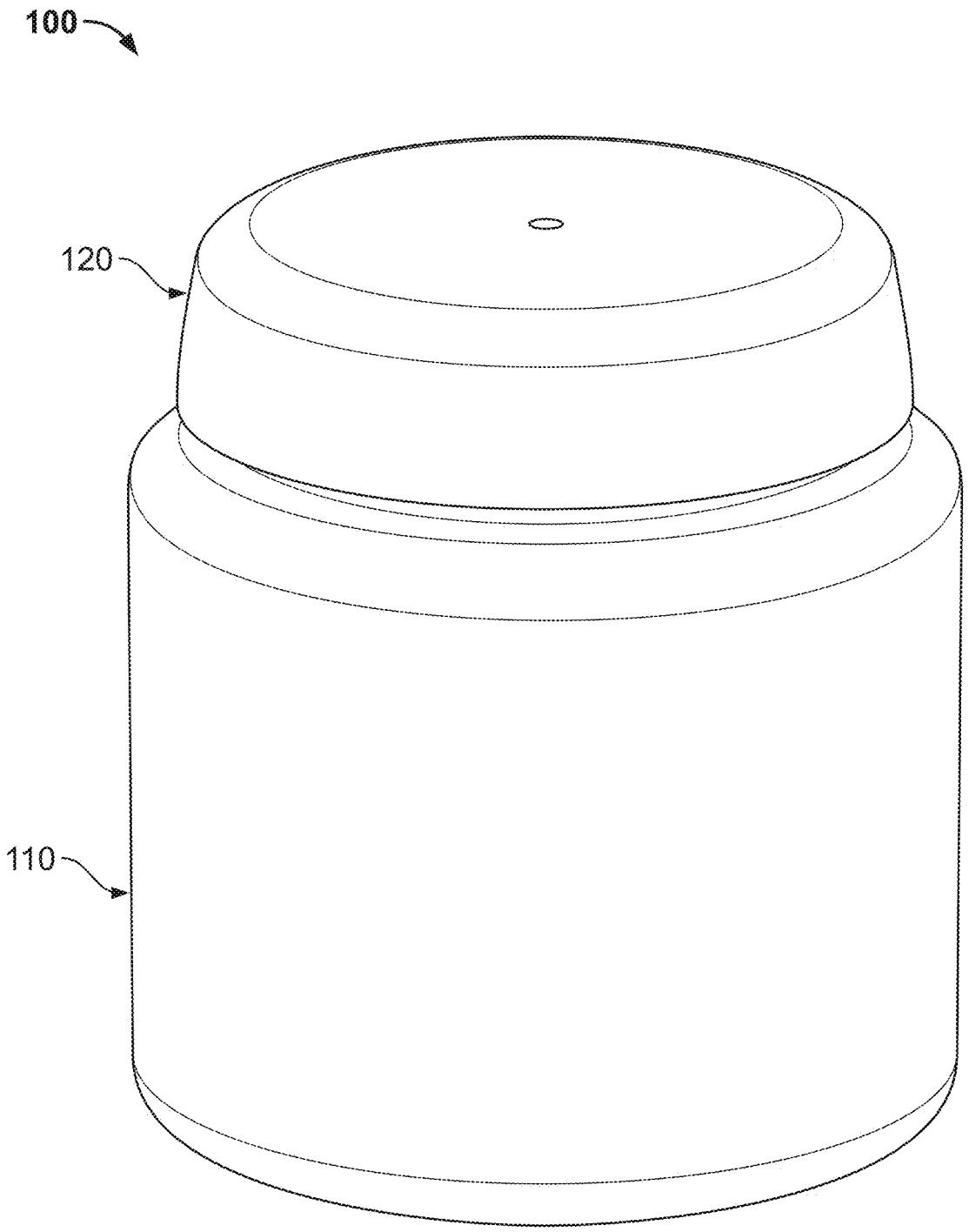
FIG. 13 is a front isometric view illustrating the closure coupled to the container of the child-resistant closure system of FIG. 1.
Figure 14:
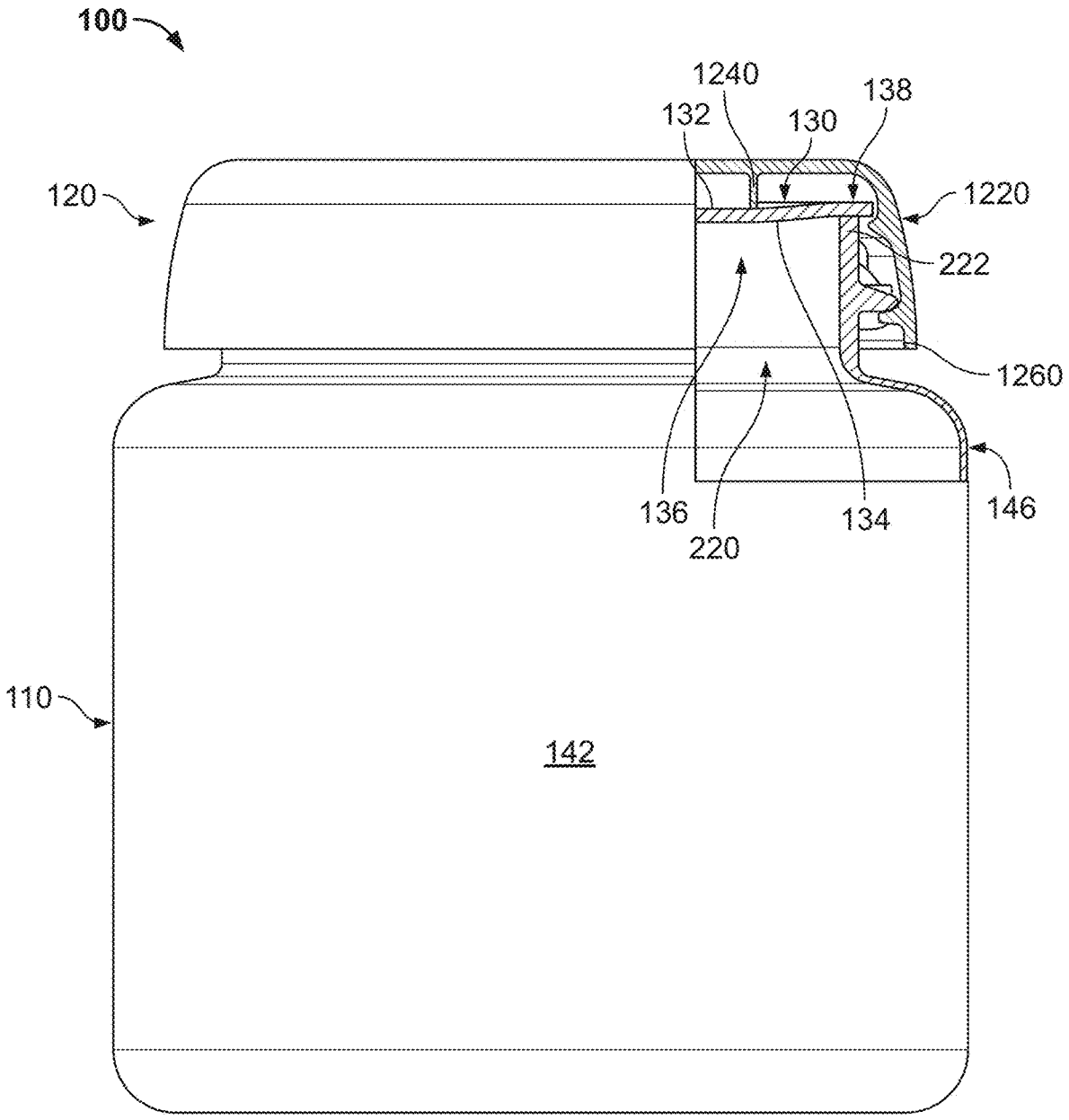
FIG. 14 is a front elevational view of the child-resistant closure system of FIGS. 1 and 13, with some portions rendered in cross-section for clarity.

FIGS. 13 and 14 illustrate the closure 120 connected to the container 110 of FIG. 1 in a locked configuration. As shown best in FIG. 14, the components of the first portion of the closure system on the neck 150 of the container interact with the components of the second portion of the closure system included in the closure 120 to form a seal.

In particular, FIG. 14 illustrates how the resilient deformable liner 130 of FIG. 1 interacts with the container 110. As shown, the resilient deformable liner 130 is positioned between the closure 120 and the container 110. Referring back to FIG. 1, the resilient deformable liner 130 can be a disk of flexible yet resilient material that is cut or shaped to fully cover the mouth 220 of the container 110. When the resilient deformable liner 130 does not have a forced applied to it, the resilient deformable liner 130 can be flat in a native state. The resilient deformable liner 130 can have a top surface 132 opposite a bottom surface 134. The resilient deformable liner 130 can include an interior or central portion 136 bounded or surrounded by an exterior portion 138. The exterior portion 138 can be surrounded or bounded by a peripheral edge 139 of the resilient deformable liner 130.

As shown best in FIG. 14, in the locked or closed configuration, the top surface 132 of the resilient deformable liner 130 can directly contact the interior platform 1240, which acts as a deflector for the resilient deformable liner 130. In a preferred embodiment, the interior platform 1240 contacts the central portion 136 of the resilient deformable liner 130. The bottom surface 134 of the resilient deformable liner 130 can contact the finished edge 222 of the mouth 220 of the container 110. In a preferred embodiment, the finished edge 222 contacts the exterior portion 138 of the resilient deformable liner 130. The resilient deformable liner 130 can be centered over the mouth 220 of the container 110 and have a continuous connection with the finished edge 222.

In some instances, the resilient deformable liner 130 can form a sealing engagement with the finished edge 222. In some instances, the resilient deformable liner 130 can lay approximately flat against the finished edge 222. In other instances, the exterior portion 138 of the resilient deformable liner 130 can be deformed or bent because of the pressure of the interior platform 1240 and the finished edge 222. As discussed herein, in some instances, the resilient deformable liner 130 can include a plurality of perforations 131 designed to permit an airflow through the resilient deformable liner 130. However, the plurality of perforations 131 do not affect the sealing engagement of the resilient deformable liner 130 with the finished edge 222.

In the locked configuration, the bottom rim 1260 of the skirt 1220 can be positioned adjacent to the second end 146 of the container. Further, in some embodiments, an outer diameter of the skirt 1220 of the closure 120 is approximately the same size as the diameter of the container wall 142. In a preferred instance, the bottom rim 1260 and the second end 146 are close enough that a child may have difficulty fitting their fingers between the components.

Figure 15:
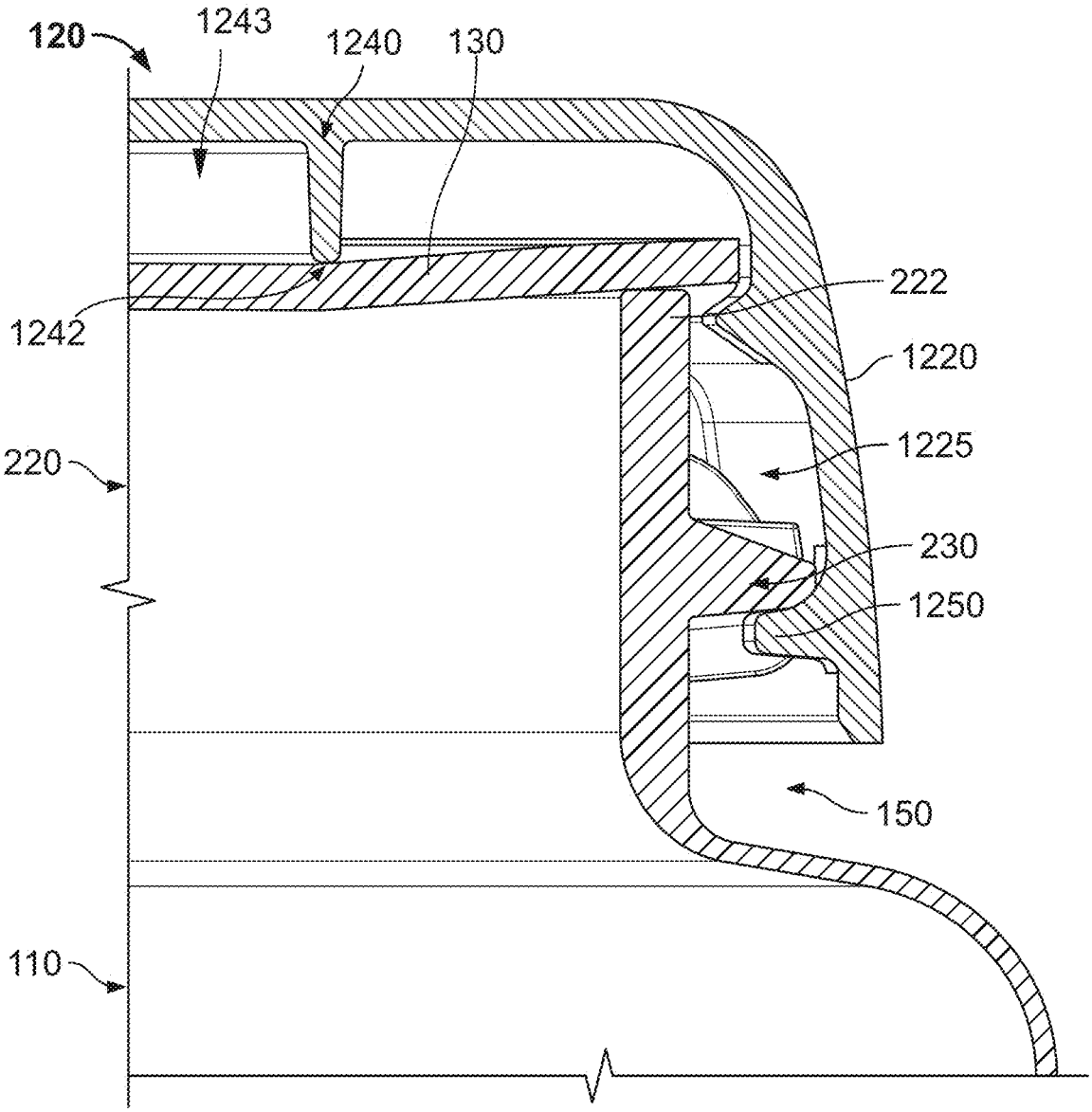
FIG. 15 is a partial cross-sectional view of the child-resistant closure system of FIGS. 1 and 13, illustrating a first locked configuration.
Figure 16:
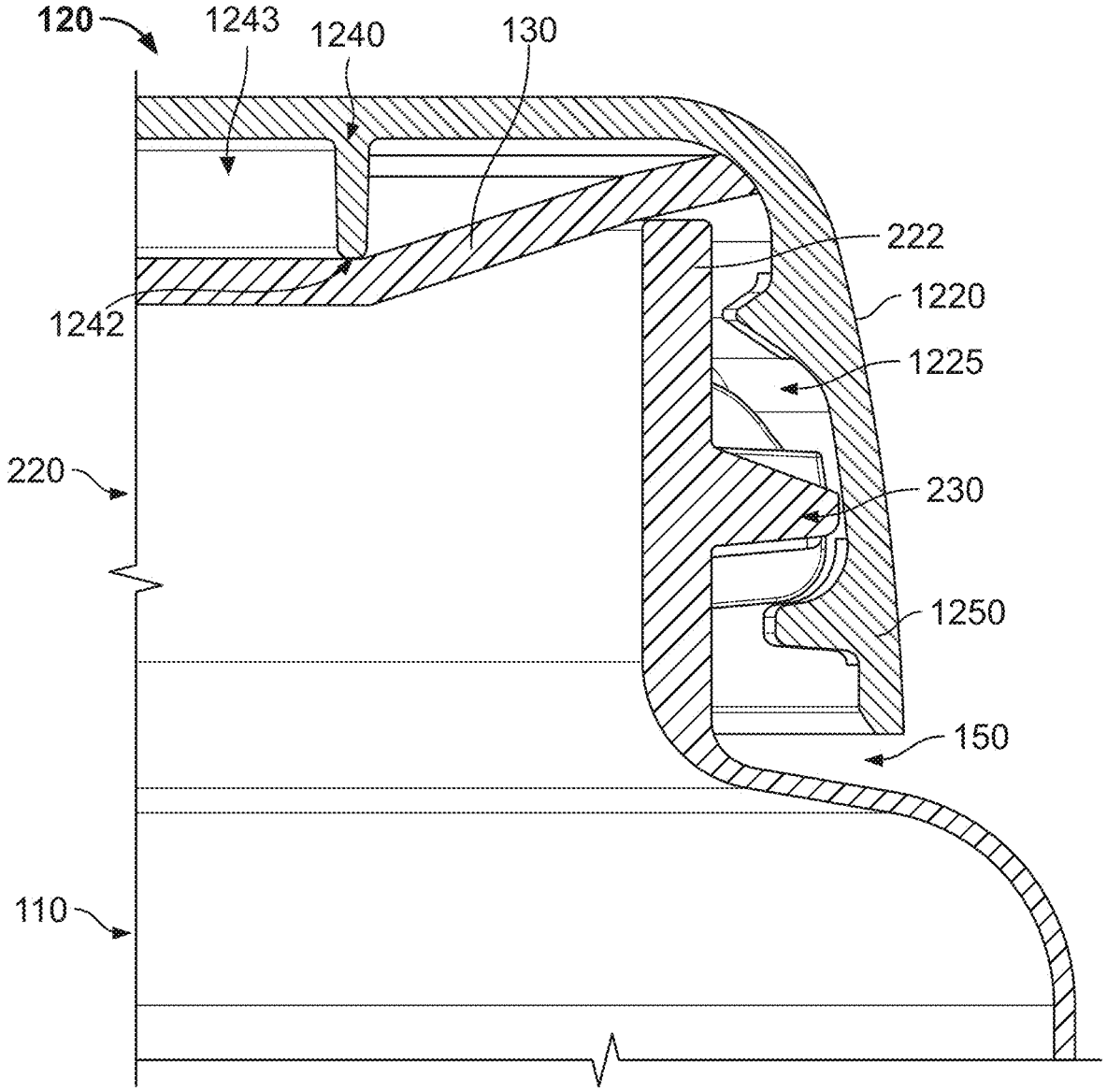
FIG. 16 is a partial cross-sectional view of the child-resistant closure system of FIGS. 1 and 13, illustrating a transitional pushed configuration.

FIGS. 15 and 16 illustrate the cross-sectional views of the child-resistant closure system of FIG. 1 in a first and second locked configuration, respectively. As shown in FIG. 15, when the child-resistant closure system is placed in the first locked configuration, the corresponding components of the first portion of the closure system (e.g., the closure components included in the container 110) and the components of the second portion of the closure system (e.g., the closure components included in the closure 120) can engage each other.

For example, the one or more bayonet closure lugs 1250 can engage a notch 580 associated with the one or more bayonet closure lugs 1250 of the at least one bayonet container component 230 of the first portion of the closure system. When it's desired to place the closure 120 into the first locked configuration with the container 110, the closure 120, including the resilient deformable liner 130, can be placed atop the mouth 220 of the container 110, so as to cover the opening of the container 110, as discussed in reference to FIG. 14.

To secure the closure 120 to the container 110, the closures 1200 and/or 1201 can be placed so that the interior surface 1210 of the top panel 1205 and the interior surface 1225 of the skirt 1220 communicates with an exterior surface of the neck 125, which includes the closure components of the first portion of the closure system (e.g., the at least one bayonet container component 230 and the at least one retaining container component 240) and/or the finished edge 222 surrounding the mouth 220.

In the first locked configuration, the one or more bayonet closure lugs 1250 engage with the at least one bayonet container component 230 and the at least one retaining container component 240. Specifically, when the closure 120 is twisted into the first locked configuration, a lugs 1250 is guided into the notch 580 by the angled portion 576 of the third segment 530 of the at least one bayonet container component 230. The stopping portion 512 of the first segment 510 of the at least one bayonet container component 230 stops the lugs 1250. Similarly, the first vertical portion 574 of the first segment 510 prevents the lugs 1250 from rotating back out of the notch 580. Accordingly, the lugs 1250 is secured within the notch 580. The closure is further secured because the second vertical portion 575 of the third segment 530 contacts a stop rib of the plurality of stop ribs 1270.

The closure 120 is still further secured in the locked configuration because a lugs 1250 engages with the at least one retaining container component 240. Specifically, the second angled portion 750 (e.g., the retaining lead-in) guides the lugs 1250 under the fifth horizontal portion 732 and behind the third vertical portion 740 (e.g., the retaining barb surface). Further, a portion of the at least one retaining container component 240 can contact or engage with a stop rib of the plurality of stop ribs 1270, which can prevent the closure 120 and associated lugs 1250 from continuing to rotate.

FIG. 16 illustrates the child-resistant closure system in a second locked configuration transitioning to an unlocked configuration. In the second locked configuration, the closure 120 is depressed by a user placing a downward force on the top panel of the closure 120. When the closure 120 is depressed, the bottom planar surface 1242 of the interior platform 1240 pushes down on the resilient deformable liner 130, while the finished edge 222 simultaneously pushes up on the exterior portion 138 of the resilient deformable liner 130. In other words, the resilient deformable liner 130 is deformed by the applied pressure. The deformation of the resilient deformable liner 130 allows the closure 120 and the container 110 to move with respect to each other so that their locking mechanisms (e.g., the components of the first and second portions of the closure system) can disengage, thus allowing the closure 120 and the container 110 to disengage and separate from each other.

To initiate the second locking configuration, the user can press the closure 120 down a minimum distance, also referred to as a push distance or transition distance. The transition distance should be sufficient to move the one or more bayonet closure lugs 1250 so that they can disengage from the notch 580 of the at least one bayonet container component 230 and/or the at least one retaining container component 240. In other words, the one or more bayonet closure lugs 1250 are pushed down towards the second end 146 of the container 110. The user can then rotate the closure 120 in a direction opposite the direction the closure 120 was turned when placing the closure 120 in the first locked position. Thus, the at least one bayonet container component 230 and/or the at least one retaining container component 240 can be rotated away from the one or more stopping ribs.

Figure 17:
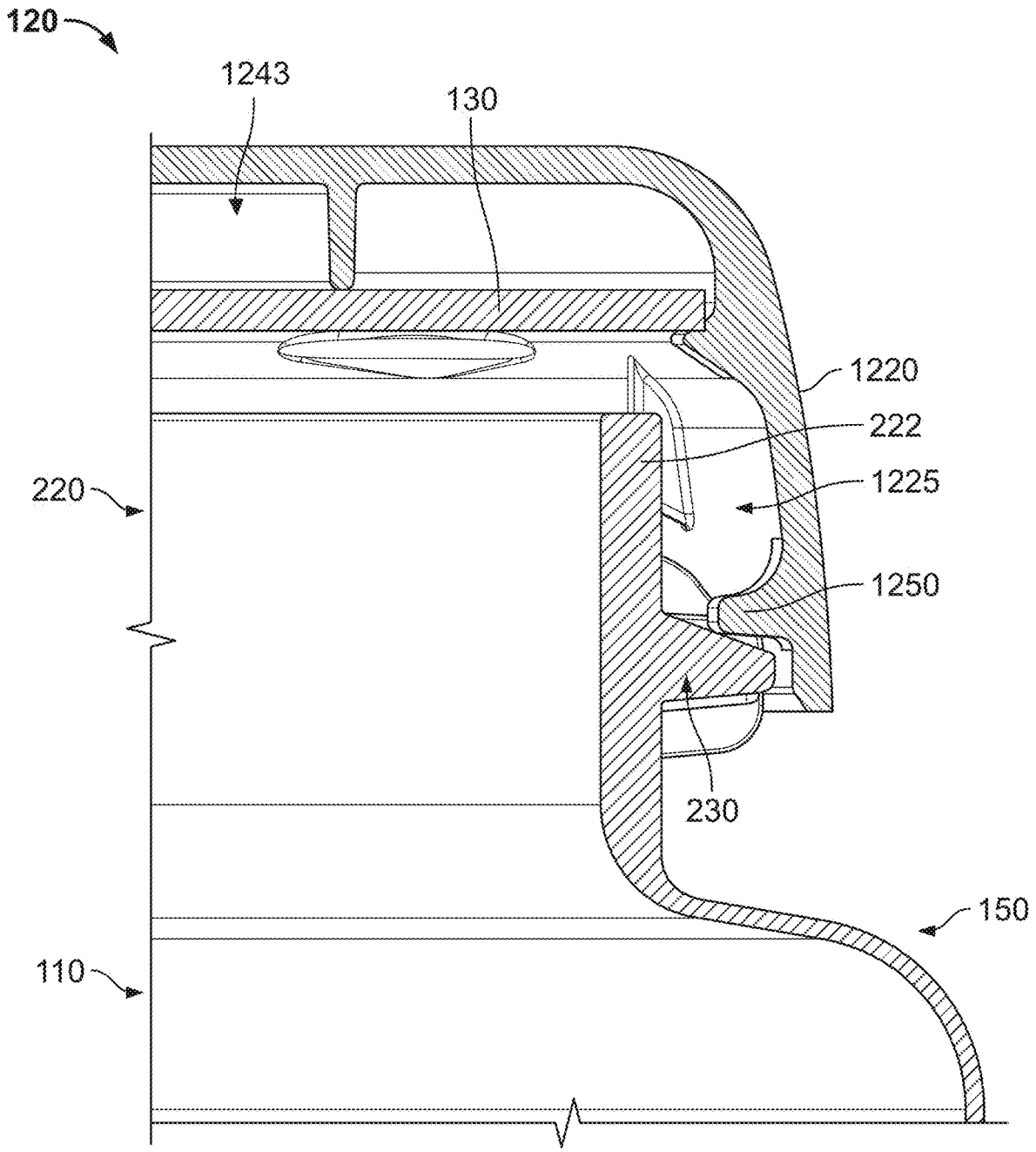
FIG. 17 is a partial cross-sectional view of the child-resistant closure system of FIGS. 1 and 13, illustrating an unlocked configuration.

FIG. 17 illustrates the closure 120 resting atop the container 110 after the closure 120 has been disengaged (i.e., unlocked) from the container 110. As shown, in the unlocked configuration, the pressure on the resilient deformable liner 130 is alleviated and the resilient deformable liner 130 can return to the native state (e.g., relatively flat configuration) illustrated in FIG. 14. Further, the second segment 520 (e.g., the ramp-like segment) of the at least one bayonet container component 230 can guide the one or more bayonet closure lugs 1250 up over the at least one bayonet container component 230. The user can then remove the closure 120 and access the internal contents of the container 110.

The components of the container 110, the closure 120, and the resilient deformable liner 130 can be made of a plastic. Non-limiting examples of the plastic include PP (Polypropylene), HDPE (High-Density Polyethylene), PETG (Polyethylene Terephthalate Glycol), and PVC (Polyvinyl Chloride). In some instances, the components of the container 110 are composed of the same plastic. In other instances, the individual components of the container 110 can be composed of two or more types of plastic.

Thus, one or more components of the container 110 can be formed through various molding methods such as injection blow molding (IBM), extrusion blow molding (EBM), stretch blow molding (SBM), injection stretch blow molding (ISBM), and other similar molding techniques known in the art.

Figure 18:
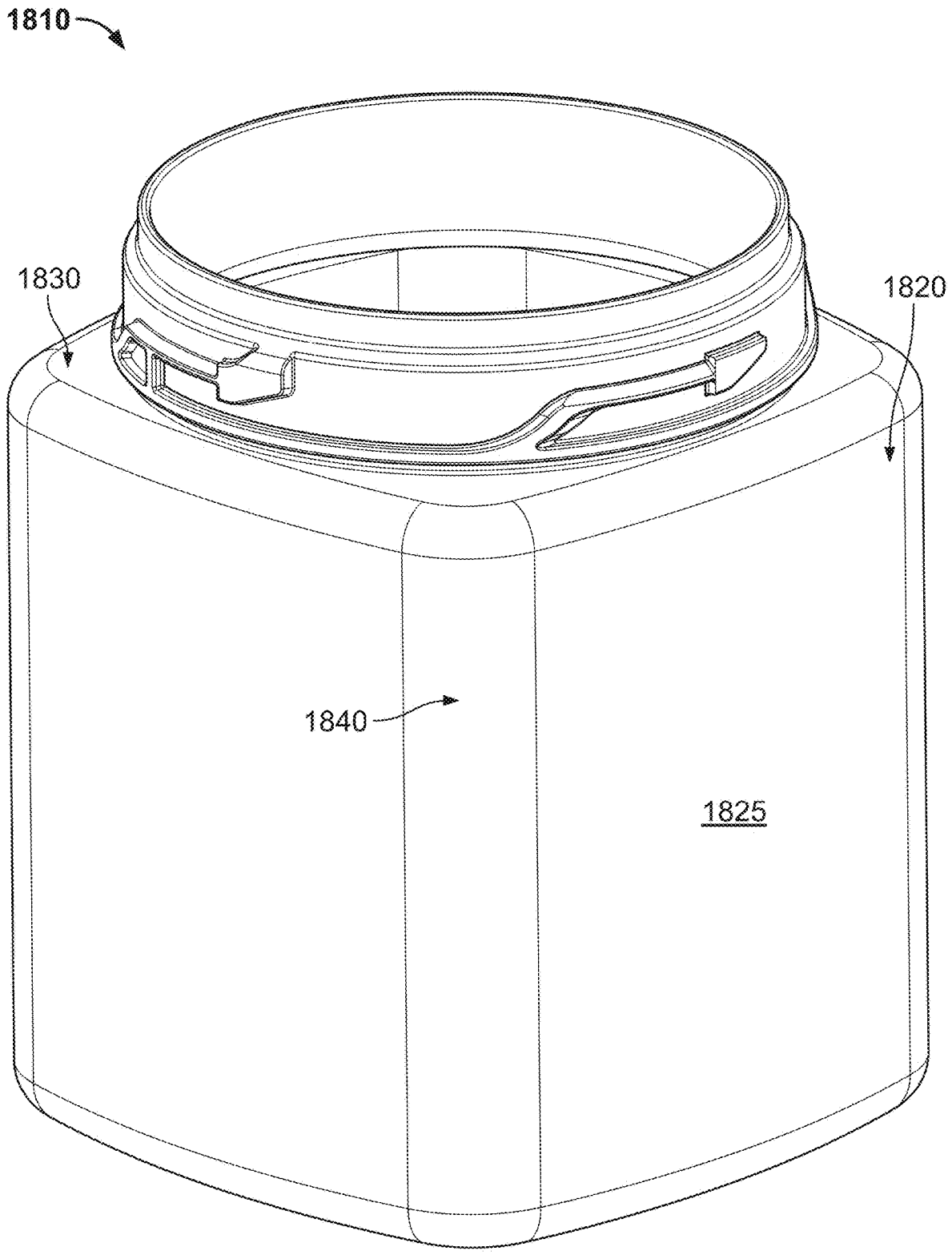
FIG. 18 is a front isometric view of a rectangular container designed to be used with the child-resistant closure system disclosed herein.
Figure 19:
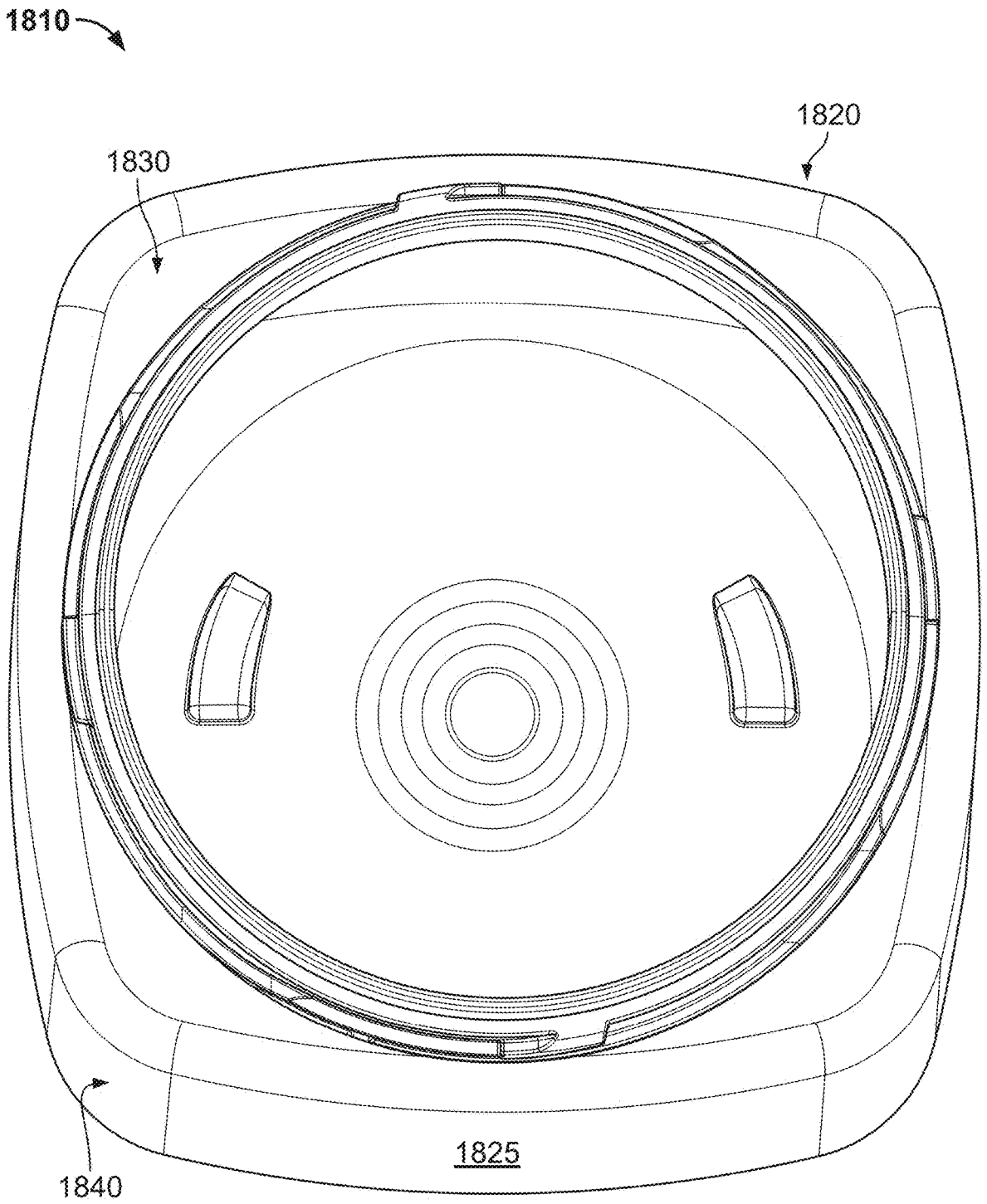
FIG. 19 is a top isometric view of a rectangular container designed to be used with the child-resistant closure system disclosed herein.
Figure 20:
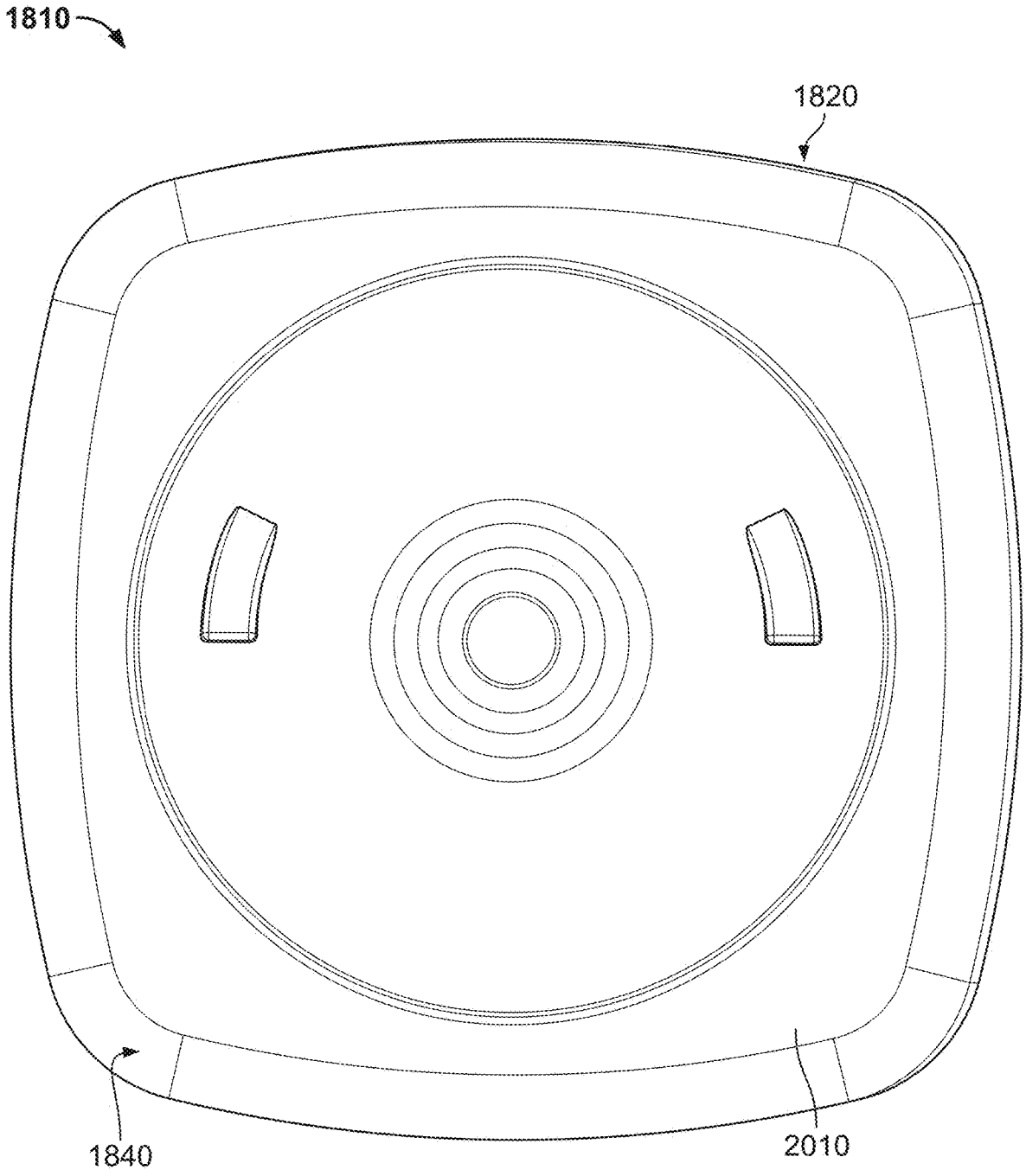
FIG. 20 is a bottom elevational view of a rectangular container designed to be used with the child-resistant closure system disclosed herein.

Further, the closure system described herein can be adapted for various container shapes and sizes. For example, the closure system can be applied to a rectangular shaped container 1810 as shown in FIGS. 18-20. The container 1810 is similar to the container 110 of FIG. 1 because the container 1810 can include the neck 150 and its associated components (e.g., the first portion of the closure system). Accordingly, the container 1810 can be used in conjunction with the closure 900 of FIG. 9, the closure 1000 of FIG. 10, and/or the closure 1100 of FIG. 11. However, the container body 1820 shape differs from the circular body 140 of the container 110 of FIG. 1.

The container body 1820 can include four approximately planar sides 1825 attached to a top portion 1830 and a base 2010. The neck 150 can be attached to, or formed as part of, the top portion 1830. Each of the top portion 1830 and the base 2010 can have an approximately square or rectangular shape. In some instances, the corners of each of the top portion 1830 and the base 2010 can be rounded or curved. Accordingly, the corners 1840 of the container body 1820 (e.g., where the sides meet) can also be rounded or curved.

Figure 21:
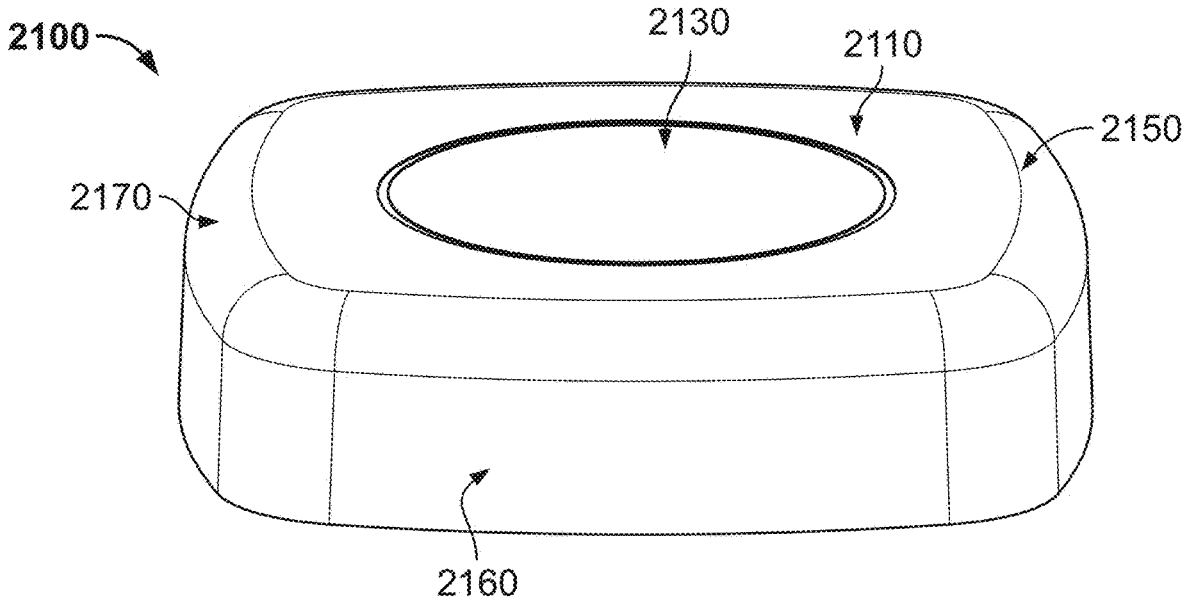
FIG. 21 is a side elevational view of an exemplary rectangular closure according to an embodiment of the disclosure.
Figure 22:
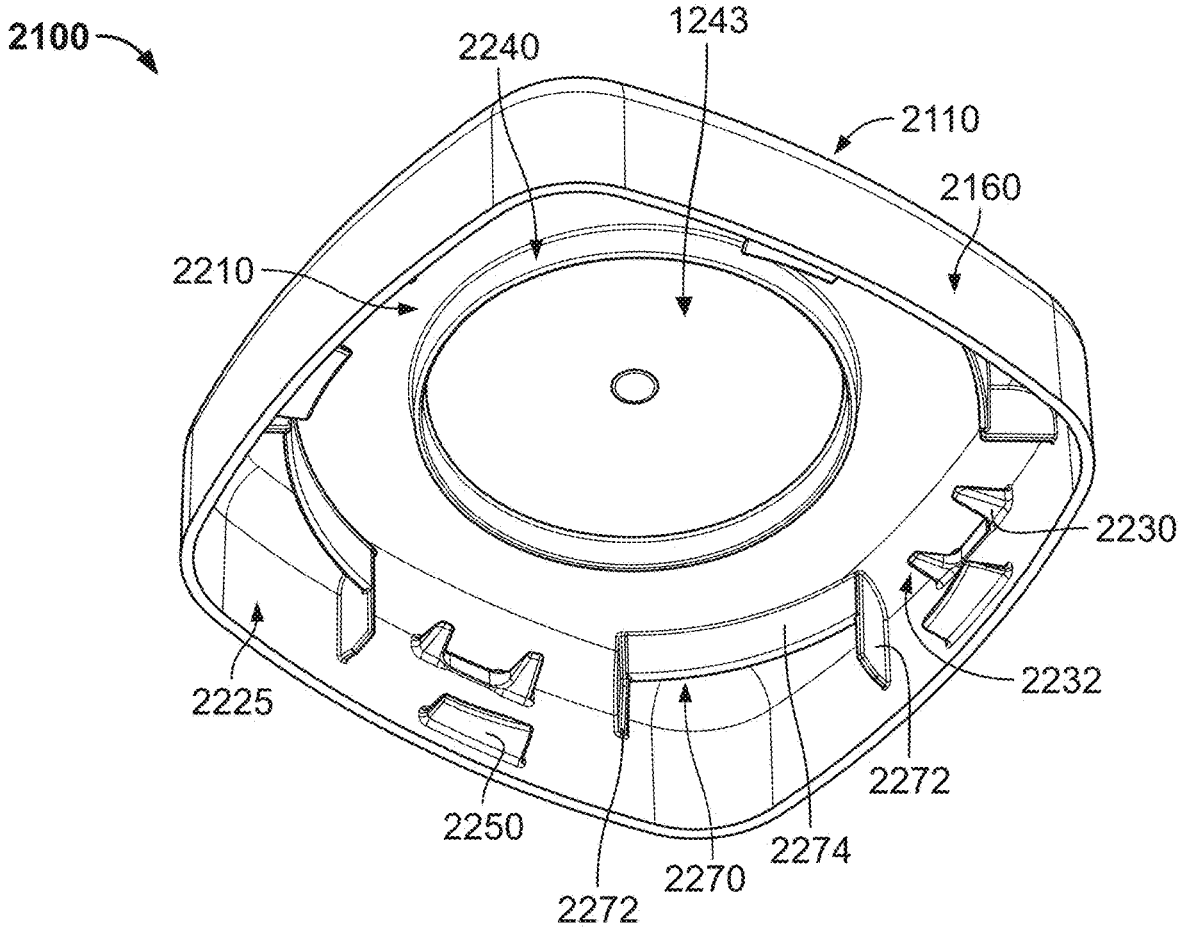
FIG. 22 is a bottom elevational view the closure of FIG. 21.

FIGS. 21 and 22 illustrate yet another exemplary closure 2100. The closure 2100 is similar to the closures 900 of FIGS. 9, 1100 of FIGS. 11, 1200 of FIG. 12A, and 1201 of FIG. 12B. The closure 2100 can have a non-rounded closure shape, such as a rectangular shaped closure as shown in FIGS. 21 and 22, that complements the rectangular container 1800 of FIGS. 18-20. However, it is to be understood that the closure 2100 can be used with any of the containers disclosed herein (e.g., the container 110 of FIG. 1 and/or the container 1810 of FIGS. 18-20.

Referring to FIG. 21 first, the closure 2100 includes a top panel 2110 having a generally rectangular shape with four rounded corners. In some instances, a central portion 2130 of the top panel 2110 can be depressed. In other instances, the central portion 2130 can have a similar elevation to the surrounding top panel 2110. The top panel 2110 can be defined by a periphery 2150. A peripheral edge 2170, adjacent to the periphery 2150, can have a sloped shape that gradually connects the top panel 2110 and associated periphery 2150 to a skirt 2160 of the closure 2100. In some instances, the peripheral edge 2170 has a rounded, curved, or convex shape. In some instances, the peripheral edge 2170 includes a plurality of grooves and/or lateral projections designed to provide a textured surface that can make it easier for a user to grip the closure 2100 (e.g., similar to the grooves 1175 of FIG. 11).

FIG. 22 illustrates a bottom or internal view of the components of the closure 2100 of FIG. 21. The internal components of the closure 2100 are similar to the internal components of the closures 1200 and 1201 of FIGS. 12A and 12B, respectively. Accordingly, the closure 2100 includes an interior surface 2210 of the top panel 2110. The bounds of the interior surface 2210 can be defined by the skirt 2160. Thus, the interior surface 2210 can be provided in the form of a generally rectangular shape. An interior surface 2225 of the skirt 2160 includes various components of a second portion of a closure system, wherein the second portion is designed to work in combination with a first portion of a closure system included on a finish of a container (e.g., the container 110 of FIG. 1 and/or the container 1800 of FIGS. 18-20).

In particular, the interior surface 2225 of the skirt 2160 includes one or more liner retainers 2230 designed to secure, support, buttress, or retain a resilient deformable liner (e.g., the resilient deformable liner 130 of FIG. 1) within the interior of the closure 2100. The liner retainers 2230 can have a similar structure and purpose to the liner retainers 1230 of FIGS. 12A and 12B (e.g., including one or more projections or spikes 2232 designed to help retain a liner). Due to the generally rectangular shape of the closure 2100, in some instances, each side of the interior surface 2225 of the skirt 2160 can include one or more liner retainers 2230. For example, as shown in FIG. 22, each side of the interior surface 2225 can include at least one liner retainer 2230 positioned in approximately the center of the associated side that the liner retainer 2230 is located on.

An interior platform 2240 can be designed to further secure the resilient deformable liner 130. The interior platform 2240 can be provided in the form of the interior platform 1240 of FIG. 12 (e.g., having a generally circular shape). However, it is to be understood that that the interior platform 2240 can be provided in other non-circular shapes, such as a rectangular shape. Thus, the interior platform 2240 can mimic the shape of the closure 2100 in some examples.

The closure 2100 can further include one or more bayonet closure lugs 2250 positioned around the circumference of the interior surface 2225 of the skirt 2160. The one or more bayonet closure lugs 2250 can have a similar structure and purpose to the one or more bayonet closure lugs 1250 of FIGS. 12A and 12B. Similar to the one or more liner retainers 2230, each side of the interior surface 2225 can include one bayonet closure lug 2250 positioned in approximately the center of the associated side the bayonet closure lug 2250 is located on. In some instances, the one or more bayonet closure lugs 2250 are positioned approximately in-line with, or underneath, the one or more liner retainers 2230.

The closure 2100 also includes a plurality of stop rib structures 2270. The plurality of stop rib structures 2270 serve a similar purpose to the plurality of stop ribs 1270 of FIGS. 12A and 12B. However, the structure of the plurality of stop rib structures 2270 differs from the structure of the plurality of stop ribs 1270 of FIGS. 12A and 12B. In particular, each stop rib structure of the plurality of stop rib structures 2270, includes two vertical ribs 2272 connected via a support rib 2274. Each of the two vertical ribs 2272 can define a structure resembling a ridge, with the ridge oriented to be substantially perpendicular to the interior surface 2210 of the top panel 2110 and/or the interior surface 2225 of the skirt 2160. The vertical ribs 2272 also extend outwardly from the interior surface 2225 of the skirt 2160. The vertical ribs 2272 can be positioned around the circumference of the interior surface 2225. In some instances, one vertical rib of the two vertical ribs 2270 can be placed on either side of an inner corner of the closure 2100. Accordingly, at least one vertical rib 1270 can be positioned on either side of a liner retainer 2230 and/or a bayonet closure lugs 2250 on each side of the interior surface 2225.

The support rib 2274 can be provided in the form of a wall-like structure that extends downwardly from the interior surface 2210 of the top panel 2110 and connects the two vertical ribs of a single stop rib structure 2270. The support rib 2274 can provide structural support for the closure 2100 by helping to reinforce the corners of the closure 2100.

Specific embodiments of a child-resistant closure system have been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

What is claimed is:

1. A child-resistant closure system, comprising:
a container including:
a neck including a mouth defining an opening into a body of the container, the neck including a rim encircling the neck and extending outwardly from the neck at a first distance;
a finished edge defining the mouth; and
a first portion of a closure system including:
a bayonet container component including:
a notch designed to engage with a first lug;
a first segment extending outwardly from the neck and parallel to the rim, the first segment including a stopping portion perpendicular to the rim;
a second segment extending outwardly from the neck and connected to a first end of the first segment and extending downwardly at an acute angle from the first segment towards the body of the container; and
a third segment extending outwardly from the neck connected to a second end of the first segment opposite the first end, the third segment including a first vertical portion positioned perpendicular to the rim and parallel to the stopping portion; and
a retaining container component designed to engage with a second lug;
a closure designed to be secured to the container, the closure including a second portion of the closure system including:
the first lug;
the second lug;
at least one liner retainer; and
at least one stop rib; and
a resilient deformable liner held within an interior portion of the closure with the at least one liner retainer,
wherein when the closure is secured to the container in a locked configuration the first lug is retained in the notch, the second lug is retained by the retaining container component, and the liner is positioned between the finished edge of the container and at least a portion of the interior portion of the closure when the closure is secured to the container, and
wherein the third segment includes:
a first horizontal portion positioned above and parallel to the rim;
a second horizontal portion positioned below and parallel to the rim;
a third horizontal portion positioned above and parallel to the first horizontal portion;
the first vertical portion positioned between and contacting the first horizontal portion and the second horizontal portion; and
a second vertical portion positioned between and contacting and the second horizontal portion and the third horizontal portion.

2. The child-resistant closure system of claim 1, wherein the retaining container component includes:
a fourth segment extending outwardly from the neck and parallel to the rim; and
a fifth segment extending outwardly from the neck and having a barbed shape.

3. The child-resistant closure system of claim 2, wherein the fifth segment includes:
a fourth horizontal portion parallel to the rim;
a fifth horizontal portion positioned below and parallel to the rim; and
a third vertical portion extending downwardly from the rim at an acute angle and positioned between and contacting the fourth horizontal portion and the fifth horizontal portion.

4. The child-resistant closure system of claim 1, wherein the container is produced through a molding technique selected from the group consisting of injection blow molding, extrusion blow molding, stretch blow molding, injection stretch blow molding, and compression molding.

5. A child-resistant closure system, comprising:
a container including:
a neck including a mouth defining an opening into a body of the container;
a first portion of a closure system including:
a rim encircling the neck and extending outwardly from the neck at a first distance;
a plurality of bayonet container components extending outwardly from the neck a second distance greater than the first distance, including:
a first segment parallel to the rim, the first segment including a stopping portion perpendicular to the rim;
a second segment connected to a first end of the first segment and extending downwardly at an acute angle from the first segment towards the body of the container; and
a third segment connected to a second end of the first segment opposite the first end, the third segment including a first vertical portion positioned perpendicular to the rim and parallel to the stopping portion, wherein a notch is formed between the stopping portion and the first vertical portion; and
a plurality of retaining container components comprising:
a fourth segment extending outwardly from the neck and parallel to the rim; and
a fifth segment extending outwardly from the neck, the fifth segment including:
a first horizontal portion parallel to the rim;
a second horizontal portion positioned below and parallel to the rim; and
a second vertical portion extending downwardly from the rim at an acute angle and positioned between and contacting the first horizontal portion and the second horizontal portion; and a closure designed to be secured to the container, the closure including a second portion of the closure system including a plurality of bayonet closure lugs designed to engage with the plurality of bayonet container components, wherein when the closure is secured to the container in a locked configuration the plurality of bayonet closure lugs are each retained in the notch of the plurality of bayonet container components.

6. The child-resistant closure system of claim 5, wherein the plurality of retaining container components are designed to engage with one or more of the plurality of bayonet closure lugs.

7. The child-resistant closure system of claim 6, wherein the plurality of bayonet container components and the plurality of retaining container components are positioned in an alternating pattern around the neck.

8. The child-resistant closure system of claim 5, wherein the second portion of the closure system includes a plurality of liner retainers designed to retain a resilient deformable liner with an interior portion of the closure.

9. The child-resistant closure system of claim 8, wherein the plurality of bayonet closure lugs are axially aligned with the plurality of liner retainers.

10. The child-resistant closure system of claim 8, wherein the closure includes an interior platform extending downwardly from an interior surface of a top panel of the closure, wherein the interior platform is designed to secure the resilient deformable liner.

11. The child-resistant closure system of claim 5, wherein the second portion of the closure system includes a plurality of stop ribs extending outwardly from an interior portion of a skirt of the neck and arranged in an alternating pattern with the plurality of bayonet closure lugs, wherein the plurality of stop ribs are designed retard a movement of the plurality of bayonet container components.

12. A child-resistant closure system, comprising:

a container including:

a hollow body;

a neck including a mouth defining an opening into the hollow body, wherein the neck is a smaller size than the hollow body;

a shoulder connecting the hollow body to the neck, the shoulder forming a sloped or curved shape to provide structural support between the hollow body and the neck;

a finished edge defining the mouth; and a first portion of a closure system including:

a bayonet container component including a notch designed to engage a first lug and a ramp designed to guide a second lug; and a retaining container component designed to engage with the second lug;

a closure designed to be secured to the container, the closure including a second portion of the closure system including:

the first lug;

the second lug; and at least one liner retainer;

a liner held within an interior portion of the closure with the at least one liner retainer designed to contact the liner, wherein when the closure is secured to the container in a locked configuration the first lug is retained in the notch, the second lug is retained by the retaining container component, and a peripheral portion of the liner is positioned between the finished edge of the container and at least a portion of the interior portion of the closure when the closure is secured to the container, wherein when the closure is transitioned from the locked configuration to an unlocked configuration by a pushing movement applied to the closure so that the liner is deformed by causing the peripheral portion of the liner to move away from the at least one liner retainer, and the pushing movement allows the first lug to disengage from the notch and the second lug to disengage from the retaining container component.

13. The child-resistant closure system of claim 12, wherein in the locked configuration, the at least one liner retainer do not contact the mouth of the container.

14. The child-resistant closure system of claim 12, wherein in the locked configuration, the liner adopts a deformed configuration where an external portion of the liner is positioned above a central portion of the liner.

15. The child-resistant closure system of claim 12, wherein the notch has a first height, the first lug has a second height approximately equal to the first height, and wherein transitioning the closure from the locked configuration to the unlocked configuration includes pushing the closure down a transitioning distance that is greater than the first height so that the lug disengages from the notch.

16. The child-resistant closure system of claim 12, wherein in the unlocked configuration, the ramp of the bayonet container component is designed to guide the second lug that disengaged from the retaining container component up and over the bayonet container component as the closure is rotated.

17. The child-resistant closure system of claim 12, wherein the closure includes a plurality of stop ribs designed to retard the movement of the bayonet container component and the retaining container component when the closure is in the locked configuration.

* * * * *